US010156356B2

(12) United States Patent
Colannino et al.

(10) Patent No.: US 10,156,356 B2
(45) **Date of Patent: *Dec. 18, 2018**

(54) FLAME VISUALIZATION CONTROL FOR A BURNER INCLUDING A PERFORATED FLAME HOLDER

(71) Applicant: ClearSign Combustion Corporation, Seattle, WA (US)

(72) Inventors: Joseph Colannino, Bellevue, WA (US); Douglas W. Karkow, Des Moines, WA (US); Robert Geiger, Seattle, WA (US); Christopher A. Wiklof, Everett, WA (US)

(73) Assignee: CLEARSIGN COMBUSTION CORPORATION, Seattle, WA (US)

( * ) Notice: Subject to any disclaimer, the term of this patent is extended or adjusted under 35 U.S.C. 154(b) by 105 days.

This patent is subject to a terminal disclaimer.

(21) Appl. No.: 15/132,807

(22) Filed: Apr. 19, 2016

(65) Prior Publication Data

US 2016/0305660 A1 Oct. 20, 2016

Related U.S. Application Data

(63) Continuation-in-part of application No. PCT/US2014/060534, filed on Oct. 14, 2014.

(Continued)

(51) Int. Cl.
*F23C 5/00* (2006.01)
*F23N 1/02* (2006.01)

(Continued)

(52) U.S. Cl.
CPC ..... *F23N 1/022* (2013.01); *F23C 99/001* (2013.01); *F23N 5/08* (2013.01); *F23N 5/082* (2013.01);

(Continued)

(58) Field of Classification Search
CPC . F23N 1/022; F23N 5/08; F23N 5/082; F23C 99/001

(Continued)

(56) References Cited

U.S. PATENT DOCUMENTS 2,095,065 A 10/1937 Hays
3,076,605 A 2/1963 Holden (Continued)

FOREIGN PATENT DOCUMENTS

GB 1042014 9/1966
GB 2456861 7/2007

(Continued)

OTHER PUBLICATIONS

Howell, J.R., et al.; "Combustion of Hydrocarbon Fuels Within Porous Inert Media," Dept. of Mechanical Engineering, The University of Texas at Austin. Prog. Energy Combust. Sci., 1996, vol. 22, pp. 121-145.

(Continued)

*Primary Examiner* — Vivek Shirsat
(74) *Attorney, Agent, or Firm* — Christopher A. Wiklof; Nicholas S. Bromer; Launchpad IP, Inc.

(57) ABSTRACT

A combustion system includes a perforated flame holder, a camera, and a control circuit. The perforated flame holder sustains a combustion reaction within the perforated flame holder. The image capture device takes a plurality of images of the combustion reaction. The control circuit produces from the images an averaged image and adjusts the combustion reaction based on the adjusted image.

19 Claims, 19 Drawing Sheets

Related U.S. Application Data

(60) Provisional application No. 61/890,668, filed on Oct. 14, 2013.

(51) Int. Cl.
*F23C 99/00* (2006.01)
*F23N 5/08* (2006.01)

(52) U.S. Cl.
CPC .... *F23D 2203/102* (2013.01); *F23D 2208/10* (2013.01); *F23N 2029/04* (2013.01); *F23N 2029/20* (2013.01)

(58) Field of Classification Search
USPC ..... 431/18–90, 100, 170, 8, 13, 14
See application file for complete search history.

(56) References Cited

U.S. PATENT DOCUMENTS

| | | | | |
|---|---|---|---|---|
| 3,228,614 | A | 1/1966 | Bauer | |
| 3,847,536 | A | 11/1974 | Lepage | |
| 4,021,188 | A | 5/1977 | Yamagishi et al. | |
| 4,408,461 | A | 10/1983 | Bruhwiler et al. | |
| 4,413,976 | A | 11/1983 | Scherer | |
| 4,483,673 | A | 11/1984 | Murai et al. | |
| 4,519,770 | A | 5/1985 | Kesselring et al. | |
| 4,643,667 | A | 2/1987 | Fleming | |
| 4,673,349 | A | 6/1987 | Abe et al. | |
| 4,726,767 | A | 2/1988 | Nakajima | |
| 4,737,844 | A * | 4/1988 | Kohola | F23N 5/082 348/27 |
| 4,752,213 | A | 6/1988 | Grochowski et al. | |
| 4,773,847 | A | 9/1988 | Shukla et al. | |
| 4,850,862 | A * | 7/1989 | Bjerklie | F23D 14/16 431/115 |
| 4,899,696 | A | 2/1990 | Kennedy et al. | |
| 5,235,667 | A | 8/1993 | Canfield et al. | |
| 5,248,255 | A | 9/1993 | Morioka et al. | |
| 5,326,257 | A | 7/1994 | Taylor et al. | |
| 5,409,375 | A | 4/1995 | Butcher | |
| 5,439,372 | A | 8/1995 | Duret et al. | |
| 5,441,402 | A | 8/1995 | Reuther et al. | |
| 5,458,484 | A | 10/1995 | Ripka | |
| 5,511,516 | A | 4/1996 | Moore, Jr. et al. | |
| 5,641,282 | A | 6/1997 | Lee et al. | |
| 5,685,708 | A | 11/1997 | Palmer-Jones | |
| 5,784,889 | A | 7/1998 | Joos et al. | |
| 5,899,686 | A | 5/1999 | Carbone et al. | |
| 5,993,192 | A | 11/1999 | Schmidt et al. | |
| 6,997,701 | B2 | 2/2006 | Volkert et al. | |
| 7,360,506 | B2 | 4/2008 | Shellenberger et al. | |
| 8,387,399 | B1 * | 3/2013 | York | F23N 5/082 60/772 |
| 8,851,882 | B2 | 10/2014 | Hartwick et al. | |
| 9,062,882 | B2 | 6/2015 | Hangauer et al. | |
| 9,377,190 | B2 | 6/2016 | Karkow et al. | |
| 9,388,981 | B2 | 7/2016 | Karkow et al. | |
| 9,447,965 | B2 | 9/2016 | Karkow et al. | |
| 2002/0088442 | A1 | 7/2002 | Hansen et al. | |
| 2003/0003590 | A1 | 1/2003 | Abbasi et al. | |
| 2003/0054313 | A1 | 3/2003 | Rattner et al. | |
| 2004/0081933 | A1 | 4/2004 | St. Charles et al. | |
| 2005/0208442 | A1 | 9/2005 | Heiligers et al. | |
| 2006/0141413 | A1 * | 6/2006 | Masten | F23D 14/16 431/328 |
| 2007/0020567 | A1 | 1/2007 | Branston et al. | |
| 2007/0186872 | A1 | 8/2007 | Shellenberger et al. | |
| 2008/0124666 | A1 | 5/2008 | Stocker et al. | |
| 2008/0268387 | A1 | 10/2008 | Saito et al. | |
| 2009/0111063 | A1 | 4/2009 | Boardman et al. | |
| 2010/0178219 | A1 | 7/2010 | Verykios et al. | |
| 2011/0076628 | A1 | 3/2011 | Miura et al. | |
| 2011/0085030 | A1 | 4/2011 | Poe et al. | |
| 2012/0164590 | A1 | 6/2012 | Mach | |
| 2012/0231398 | A1 | 9/2012 | Carpentier et al. | |
| 2013/0071794 | A1 | 3/2013 | Colannino et al. | |
| 2015/0118629 | A1 | 4/2015 | Colannino et al. | |
| 2015/0276217 | A1 | 10/2015 | Karkow et al. | |
| 2015/0285491 | A1 | 10/2015 | Karkow et al. | |
| 2015/0316261 | A1 | 11/2015 | Karkow et al. | |
| 2015/0330625 | A1 | 11/2015 | Karkow et al. | |
| 2015/0362177 | A1 | 12/2015 | Krichtafovitch et al. | |
| 2015/0362178 | A1 | 12/2015 | Karkow et al. | |
| 2015/0369477 | A1 | 12/2015 | Karkow et al. | |
| 2016/0003471 | A1 | 1/2016 | Karkow et al. | |
| 2016/0018103 | A1 | 1/2016 | Karkow et al. | |
| 2016/0025333 | A1 | 1/2016 | Karkow et al. | |
| 2016/0025374 | A1 | 1/2016 | Karkow et al. | |
| 2016/0025380 | A1 | 1/2016 | Karkow et al. | |
| 2016/0046524 | A1 | 2/2016 | Colannino et al. | |
| 2016/0091200 | A1 | 3/2016 | Colannino et al. | |
| 2016/0230984 | A1 | 8/2016 | Colannino et al. | |
| 2016/0238240 | A1 | 8/2016 | Colannino et al. | |
| 2016/0238242 | A1 | 8/2016 | Karkow et al. | |
| 2016/0238277 | A1 | 8/2016 | Colannino et al. | |
| 2016/0238318 | A1 | 8/2016 | Colannino et al. | |
| 2016/0245509 | A1 | 8/2016 | Karkow et al. | |
| 2016/0298840 | A1 | 10/2016 | Karkow et al. | |

FOREIGN PATENT DOCUMENTS

| | | |
|---|---|---|
| WO | WO 1995/000803 | 1/1995 |
| WO | WO 2004/015333 | 2/2004 |
| WO | WO 2015/042615 | 3/2015 |
| WO | WO 2015/054323 | 4/2015 |
| WO | WO 2015/061760 | 4/2015 |
| WO | WO 2015/070188 | 5/2015 |
| WO | WO 2015/112950 | 7/2015 |
| WO | WO 2015/123149 | 8/2015 |
| WO | WO 2015/123381 | 8/2015 |
| WO | WO 2015/123670 | 8/2015 |
| WO | WO 2015/123683 | 8/2015 |
| WO | WO 2015/123694 | 8/2015 |
| WO | WO 2015/123696 | 8/2015 |
| WO | WO 2015/123701 | 8/2015 |
| WO | WO 2016/007564 | 1/2016 |
| WO | WO 2016/105489 | 6/2016 |
| WO | WO 2016/133934 | 8/2016 |
| WO | WO 2016/133936 | 8/2016 |
| WO | WO 2016/134061 | 8/2016 |
| WO | WO 2016/134068 | 8/2016 |
| WO | WO 2016/141362 | 9/2016 |

OTHER PUBLICATIONS

PCT International Search Report and Written Opinion of International PCT Application No. PCT/US2014/056928 dated Jan. 19, 2015.

PCT International Search Report and Written Opinion of International PCT Application No. PCT/US2014/060534 dated Jan. 19, 2015.

Arnold Schwarzenegger, "A Low NOx Porous Ceramics Burner Performance Study," California Energy Commission Public Interest Energy Research Program, Dec. 2007, San Diego State University Foundation, p. 5.

Isaksen, Øyvind; "Reconstruction Techniques for Capacitance Tomography," Meas. Sci. Technol., vol. 7, No. 3 (1996), pp. 325-337.

Liu, S., et al.; "Preliminary Study on ECT Imaging of Flames in Porous Media," Meas. Sci. Technol., vol. 19, No. 9 (2008), 7 pages.

B. Stratton et al., "Determining Flame Height and Flame Pulsation Frequency and Estimating Heat Release Rate from 3D Flame Reconstruction." Fire Engineering Research Report 05/2, Dept. of Civil Engineering, Univ. of Canterbury, Christchurch, New Zealand, Jul. 2005, 90 pages.

Waterfall, R.C., et al.; "Flame Visualizations Using Electrical Capacitance Tomography (ECT)," Process Imaging for Automatic Control, Proc. SPIE, vol. 4188 (2001), pp. 242-250.

* cited by examiner

FLAME VISUALIZATION CONTROL FOR A BURNER INCLUDING A PERFORATED FLAME HOLDER

CROSS REFERENCE TO RELATED APPLICATIONS

The present application is a Continuation-in-Part of PCT Patent Application No. PCT/US2014/060534, entitled "FLAME VISUALIZATION CONTROL FOR ELECTRODYNAMIC COMBUSTION CONTROL," filed Oct. 14, 2014, co-pending at the time of filing; which claims priority benefit from U.S. Provisional Patent Application No. 61/890,668, entitled "ELECTRODYNAMIC COMBUSTION CONTROL (ECC) TECHNOLOGY FOR BIOMASS AND COAL SYSTEMS," filed Oct. 14, 2013; each of which, to the extent not inconsistent with the disclosure herein, is incorporated by reference.

SUMMARY

According to an embodiment, a combustion system includes a fuel nozzle configured to output fuel and oxidant and a perforated flame holder. The perforated flame holder includes a first face, a second face, and a plurality of perforations extending between the first face and the second face, the first face being positioned to receive the fuel and oxidant from the fuel and oxidant source, the perforated flame holder being configured to sustain a combustion reaction of the fuel and oxidant within the perforations. The combustion system further includes an image capture device configured to capture a plurality of images of the combustion reaction and a control circuit configured to produce from the plurality of images an average image of the combustion reaction.

DETAILED DESCRIPTION

Figure 1:
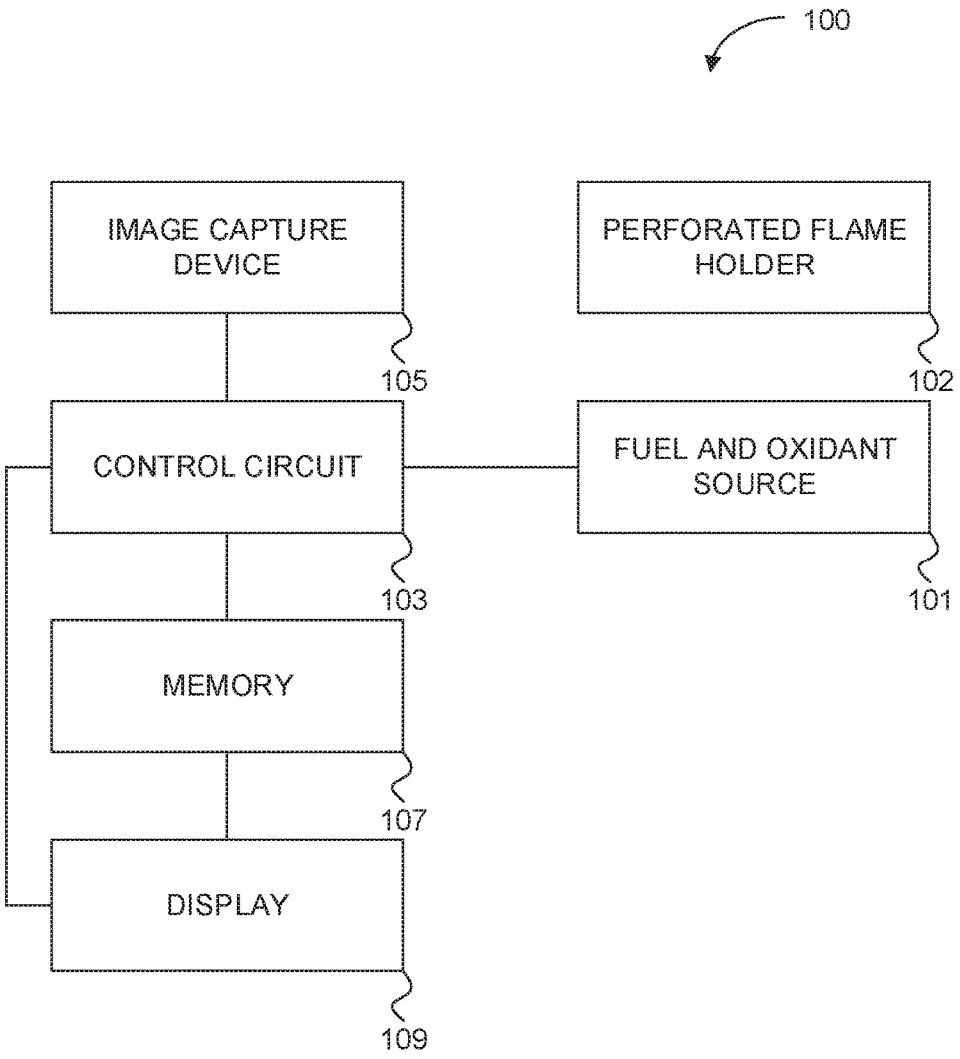
FIG. 1 is a block diagram of a combustion system including a perforated flame holder and a camera, according to an embodiment.

In the following detailed description, reference is made to the accompanying drawings, which form a part hereof. In the drawings, similar symbols typically identify similar components, unless context dictates otherwise.

Other embodiments may be used and/or other changes may be made without departing from the spirit or scope of the disclosure.

FIG. 1 is a block diagram of a combustion system 100 according to one embodiment. The combustion system 100 includes a fuel and oxidant source 101, a perforated flame holder 102, a control circuit 103, an image capture device 105, a memory 107, and a display 109.

The fuel and oxidant source 101 is configured to output fuel and oxidant onto the perforated flame holder 102. According to an embodiment, the perforated flame holder 102 includes a first face, a second face, and a plurality of perforations extending between the first face and the second face. A combustion reaction of the fuel and oxidant is sustained primarily within the perforations.

According to an embodiment, in some circumstances it may be desirable to keep the perforated flame holder 102 within a selected temperature range. Additionally, in some circumstances it may be desirable to have a particular distribution of temperature throughout the perforated flame holder. However, it is possible in some instances for the combustion reaction to take on undesirable characteristics. For example, the combustion reaction can become too hot, too cool, unevenly distributed throughout the perforated flame holder, too much of the combustion reaction may occur above or below the perforated flame holder 102, or other possible problematic characteristics.

According to an embodiment, the image capture device 105 is positioned to capture images of the combustion reaction. The captured images can include visible spectrum imaging, infrared imaging, ultraviolet imaging, or a combination of these or other types of images. The image capture device 105 can rapidly capture multiple successive images or can capture individual images for display or analysis. The images can provide an indication of the location of the combustion reaction, the temperature of the combustion reaction and/or the perforated flame holder 102, the distribution of the combustion reaction within the perforated flame holder 102, how much of the combustion reaction is above or below the perforated flame holder 102, or other aspects of the combustion reaction or perforated flame holder 102.

Because of the fluidity of combustion reaction characteristics, it can be very difficult to determine whether or not a particular image corresponds to a selected combustion reaction shape or selected combustion reaction characteristics. The inventors discovered that, by averaging a number of successive image frames, a truer representation of combustion reaction characteristics can be obtained. The averaged image frames can thus be used for feedback control of the combustion system 100.

In one embodiment, the image capture device 105 provides the plurality of images to the control circuit 103. The control circuit 103 produces from the plurality of images an averaged image of the combustion reaction. The averaged image provides information about the average position, distribution, temperature profile, and/or other characteristics of the combustion reaction and/or the perforated flame holder 102. The averaged image can therefore give an indication of how the combustion reaction is distributed within the perforated flame holder 102, whether excessive portions of the combustion reaction are above or below the perforated flame holder 102, the temperature distribution of the perforated flame holder, how much heat is output from the perforated flame holder 102, or other characteristics of the combustion reaction and/or the perforated flame holder 102. The control circuit 103 can adjust the combustion reaction based on the averaged image in order to obtain a combustion reaction with selected characteristics. Additionally or alternatively the control circuit 103 can adjust the combustion reaction based on analysis of a single image or a plurality of images instead of or in addition to an averaged image.

The control circuit 103 can adjust the combustion reaction in a variety of ways. In one embodiment, the control circuit can adjust the combustion reaction by stopping the output of fuel and oxidant from the fuel and oxidant source 101. Stopping the output of fuel and oxidant will stop the combustion reaction. In one embodiment, the control circuit 103 can control the fuel and oxidant source 101 to adjust the fuel and oxidant coming from the fuel and oxidant source 101. In particular, the control circuit 103 can adjust the velocity of the fuel, the flow rate of the fuel, the direction of flow of the fuel, or the concentration of fuel in the fuel and oxidant mixture in order to obtain a combustion reaction with selected characteristics. The control circuit 103 may also adjust the air or air/fuel ratio or one or more other combustion control parameters. In one example, the image capture device captures one or more images of the perforated flame holder 102 and provides them to the control circuit 103. The control circuit analyzes the one or more images, or an averaged image based on the one or more images. The one or more images indicate that some portions of the perforated flame holder 102 are significantly hotter than other portions of the perforated flame holder. This may indicate that the fuel and oxidant are not being received uniformly across the perforated flame holder 102. The control circuit 103 can adjust an output of the fuel and oxidant to more evenly distribute the fuel and oxidant to the perforated flame holder 102. The control circuit 103 can adjust the output of fuel and oxidant based on analysis of a single image, multiple images, and/or an averaged image created from multiple images.

In one embodiment, the control circuit 103 can determine combustion reaction characteristics based on the colors or wavelengths of light associated with the combustion reaction at the various areas of the perforated flame holder. The one or more images can indicate visible spectrum colors or wavelengths outside the visible spectrum, such as ultraviolet or infrared wavelengths.

In one embodiment, the image may indicate that the perforated flame holder 102 is darker than normal. This can indicate that a significant portion of the combustion reaction occurs in blue flames above the perforated flame holder 102. In this case the control circuit can reduce the heat load. In one example adjusting the heat load includes reducing water flow to steam tubes. In one embodiment the fuel and oxidant source 101 can include one or more fuel nozzles each having one or more orifices. The control circuit can reduce fuel velocity by switching to larger orifice nozzles or by outputting the same amount of fuel through more nozzles. In one embodiment the control circuit can change the fuel mix to a higher speed fuel, for example by adding hydrogen.

In one embodiment, the control circuit 103 outputs the one or more images, or the averaged image, for display on the display 109. A technician of the combustion system 100 can analyze the one or more images on the display, or the averaged image, and can adjust the combustion reaction based on the one or more images or the averaged image. The technician can then adjust the parameters of the combustion system 100 to attain desired characteristics of the combustion reaction.

In one embodiment, the memory 107 stores combustion reaction reference data. The combustion reaction reference data may be collected from the as-new or as-desired operating condition to be stored as the combustion reaction reference data. After the control circuit 103 has produced the averaged image of the combustion reaction, the control circuit 103 can compare the averaged image to the reference data stored in the memory 107. In this way the control circuit 103 can determine if the combustion reaction has characteristics in accordance with characteristics selected by an operator of the combustion system 100 or stored in the memory 107. Based on the comparison between the averaged image and the reference data stored in the memory 107, the control circuit 103 can adjust the combustion reaction to achieve the selected characteristics.

After the control circuit 103 has adjusted the combustion reaction, the image capture device 105 captures another series of images of the combustion reaction. The control circuit 103 produces another averaged image of the combustion reaction from the most recent series of images captured by the image capture device 105. The control circuit 103 compares the new averaged image to the reference data stored in the memory 107. If the comparison indicates that the combustion reaction has characteristics substantially in accordance with the selected characteristics, then the control circuit 103 does not adjust the combustion reaction. If the comparison indicates that the combustion reaction still has not achieved the selected characteristics, then the control circuit 103 can further adjust the combustion reaction.

In one embodiment, the reference data stored in the memory 107 includes a plurality of reference images of the combustion reaction. The control circuit 103 compares the averaged image of the combustion reaction to one or more of the reference images. Based on the comparison of the averaged image to the reference images, the control circuit 103 can adjust the combustion reaction.

In one embodiment, the desired characteristics of the combustion reaction correspond to a particular target reference image stored in the memory 107. The control circuit 103 compares the averaged image to the target reference image corresponding to the selected characteristics for the combustion reaction. The control circuit 103 then adjusts the combustion reaction based on the comparison between the averaged image and the target reference image in order to conform the combustion reaction to the target reference image.

The image capture device 105 can be an infrared camera, a visible light camera, an ultraviolet light camera, a flame scanner or any other suitable image capture device that can capture images of a combustion reaction or output an indication of the characteristics of the combustion reaction.

In one embodiment, the image capture device 105 is a video camera that records a video of the combustion reaction. The control circuit 103 then averages individual frames of the video to produce the averaged image.

In one embodiment, the image capture device 105 includes an electrical capacitance tomography device. The electrical capacitance tomography device includes a plurality of electrodes positioned at selected locations adjacent to the perforated flame holder 102. The electrical tomography device makes a plurality of images representing slices of the perforated flame holder based on the capacitances between the electrodes. These images can give an indication of a concentration or flow of fuel, oxidant, and flue gasses at various locations in the perforated flame holder 102 based on the dielectric constant at the various locations of the perforated flame holder 102. The images can also give an indication of the temperature at various locations within the perforated flame holder 102. The control circuit 103 can analyze the images and adjust the combustion reaction based on the images.

The control circuit 103 can adjust the combustion reaction in a variety of ways. In one embodiment, the control circuit 103 can control the fuel and oxidant source 101 to adjust the fuel and oxidant coming from the fuel and oxidant source 101. In particular, the control circuit 103 can adjust the velocity of the fuel, the flow rate of the fuel, the direction of flow of the fuel, or the concentration of fuel in the fuel and oxidant mixture in order to obtain the combustion reaction with selected characteristics. The control circuit 103 may also adjust the air or air/fuel ratio or the one or more other combustion control parameters.

In one embodiment the image capture device 105 includes multiple image capture devices disposed at various positions relative to the perforated flame holder 102. For example, the image capture device 105 can include a first image capture device positioned to capture an image of a top surface of the perforated flame holder and a second image capture device positioned to capture an image of the fuel and oxidant source and/or a bottom surface of the perforated flame holder. The second image capture device can capture an image of a startup flame configured to preheat the perforated flame holder 102. Additionally or alternatively the second image capture device can capture an image that indicates whether the combustion reaction is near the fuel and oxidant source 101. The control circuit or a technician can adjust the combustion reaction or the preheating flame based on the image from the second image capture device.

Figure 2:
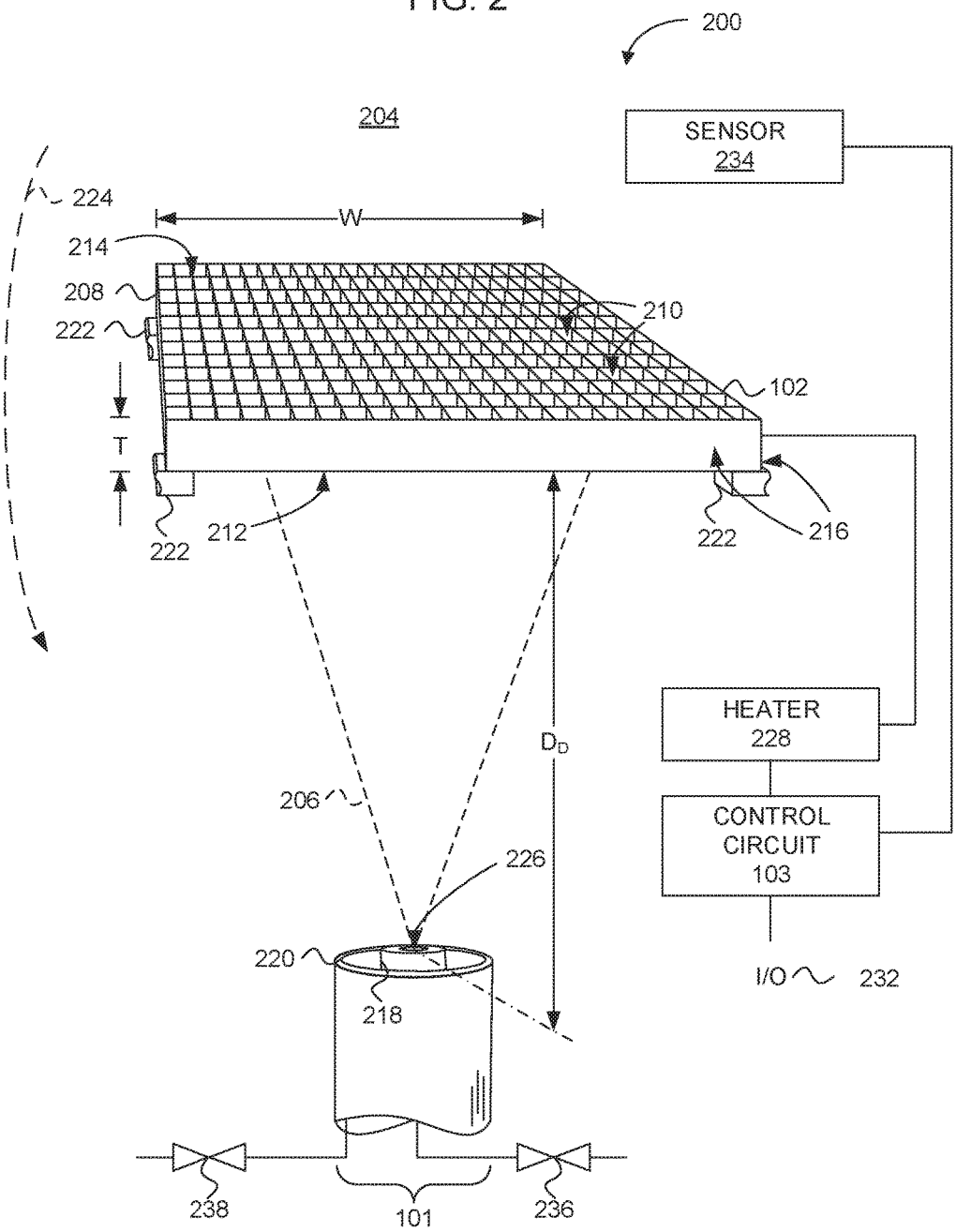
FIG. 2 is a diagram of a combustion system including a perforated flame holder, according to an embodiment.

FIG. 2 is a simplified diagram of a burner system 200 including a perforated flame holder 102 configured to hold a combustion reaction, according to an embodiment. As used herein, the terms perforated flame holder, perforated reaction holder, porous flame holder, porous reaction holder, duplex, and duplex tile shall be considered synonymous unless further definition is provided.

Experiments performed by the inventors have shown that perforated flame holders 102 described herein can support very clean combustion. Specifically, in experimental use of systems 200 ranging from pilot scale to full scale, output of oxides of nitrogen (NOx) was measured to range from low single digit parts per million (ppm) down to undetectable (less than 1 ppm) concentration of NOx at the stack. These remarkable results were measured at 3% (dry) oxygen ($O_2$) concentration with undetectable carbon monoxide (CO) at stack temperatures typical of industrial furnace applications (1400-1600° F.). Moreover, these results did not require any extraordinary measures such as selective catalytic reduction (SCR), selective non-catalytic reduction (SNCR), water/steam injection, external flue gas recirculation (FGR), or other heroic extremes that may be required for conventional burners to even approach such clean combustion.

According to embodiments, the burner system 200 includes a fuel and oxidant source 101 disposed to output fuel and oxidant into a combustion volume 204 to form a fuel and oxidant mixture 206. As used herein, the terms fuel and oxidant mixture and fuel stream may be used interchangeably and considered synonymous depending on the context, unless further definition is provided. As used herein, the terms combustion volume, combustion chamber, furnace volume, and the like shall be considered synonymous unless further definition is provided. The perforated flame holder 102 is disposed in the combustion volume 204 and positioned to receive the fuel and oxidant mixture 206.

Figure 3:
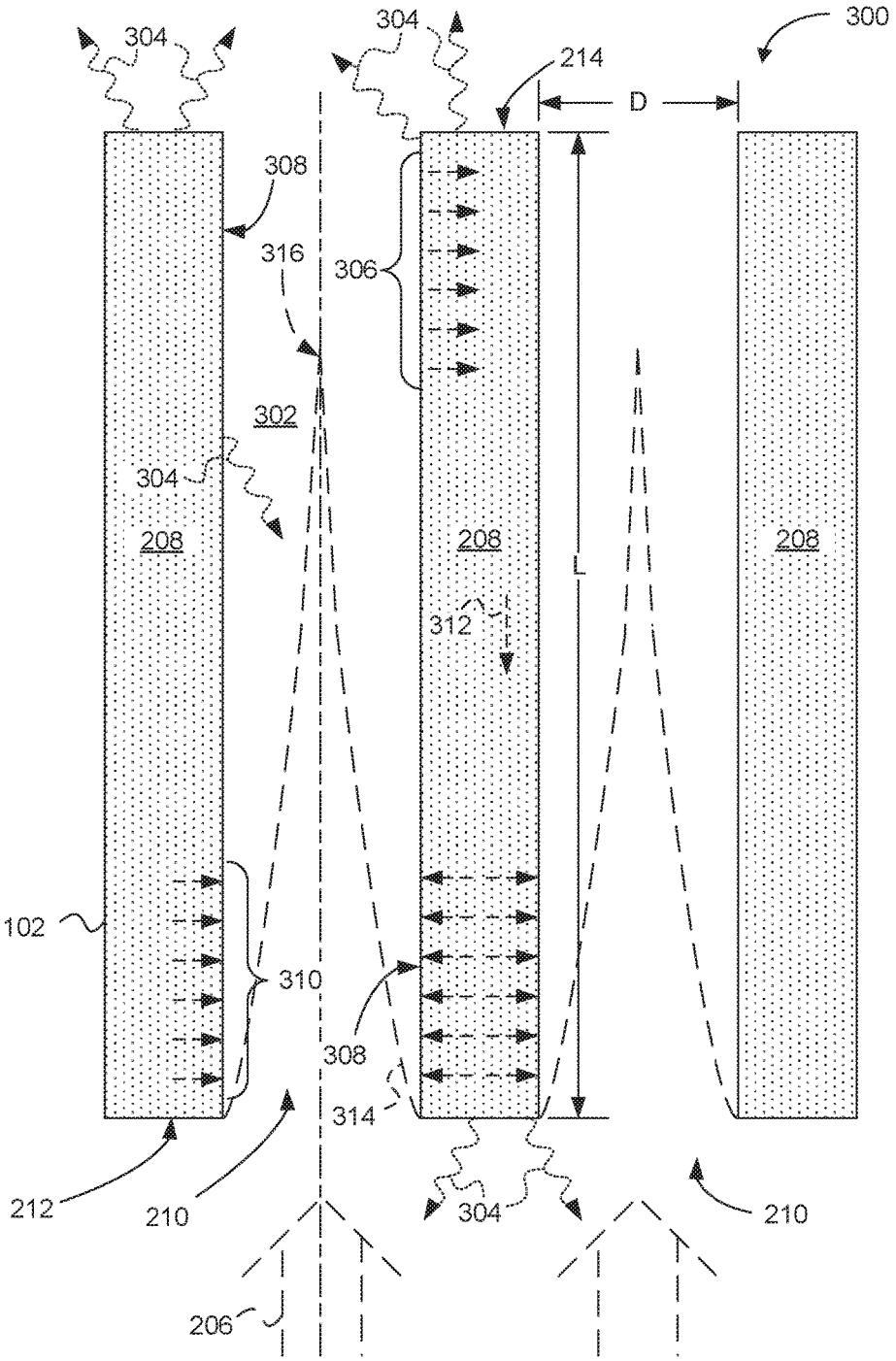
FIG. 3 is a cross-sectional diagram of a perforated flame holder, according to an embodiment.

FIG. 3 is a side sectional diagram 300 of a portion of the perforated flame holder 102 of FIGS. 1 and 2, according to an embodiment. Referring to FIGS. 2 and 3, the perforated flame holder 102 includes a perforated flame holder body 208 defining a plurality of perforations 210 aligned to receive the fuel and oxidant mixture 206 from the fuel and oxidant source 101. As used herein, the terms perforation, pore, aperture, elongated aperture, and the like, in the context of the perforated flame holder 102, shall be considered synonymous unless further definition is provided. The perforations 210 are configured to collectively hold a combustion reaction 302 supported by the fuel and oxidant mixture 206.

The fuel can include hydrogen, a hydrocarbon gas, a vaporized hydrocarbon liquid, an atomized hydrocarbon liquid, or a powdered or pulverized solid. The fuel can be a single species or can include a mixture of gas(es), vapor(s), atomized liquid(s), and/or pulverized solid(s). For example, in a process heater application the fuel can include fuel gas or byproducts from the process that include carbon monoxide (CO), hydrogen ($H_2$), and methane ($CH_4$). In another application, the fuel can include natural gas (mostly $CH_4$) or propane ($C_3H_8$). In another application, the fuel can include #2 fuel oil or #6 fuel oil. Dual fuel applications and flexible fuel applications are similarly contemplated by the inventors. The oxidant can include oxygen carried by air, flue gas, and/or can include another oxidant, either pure or carried by a carrier gas. The terms oxidant and oxidizer shall be considered synonymous herein.

According to an embodiment, the perforated flame holder body 208 can be bounded by an input face 212 disposed to receive the fuel and oxidant mixture 206, an output face 214 facing away from the fuel and oxidant source 101, and a peripheral surface 216 defining a lateral extent of the perforated flame holder 102. The plurality of perforations 210 which are defined by the perforated flame holder body 208 extend from the input face 212 to the output face 214. The plurality of perforations 210 can receive the fuel and oxidant mixture 206 at the input face 212. The fuel and oxidant mixture 206 can then combust in or near the plurality of perforations 210 and combustion products can exit the plurality of perforations 210 at or near the output face 214.

According to an embodiment, the perforated flame holder 102 is configured to hold a majority of the combustion reaction 302 within the perforations 210. For example, on a steady-state basis, more than half the molecules of fuel output into the combustion volume 204 by the fuel and oxidant source 101 may be converted to combustion products between the input face 212 and the output face 214 of the perforated flame holder 102. According to an alternative interpretation, more than half of the heat or thermal energy output by the combustion reaction 302 may be output between the input face 212 and the output face 214 of the perforated flame holder 102. As used herein, the terms heat, heat energy, and thermal energy shall be considered synonymous unless further definition is provided. As used above, heat energy and thermal energy refer generally to the released chemical energy initially held by reactants during the combustion reaction 302. As used elsewhere herein, heat, heat energy and thermal energy correspond to a detectable temperature rise undergone by real bodies characterized by heat capacities. Under nominal operating conditions, the perforations 210 can be configured to collectively hold at least 80% of the combustion reaction 302 between the input face 212 and the output face 214 of the perforated flame holder 102. In some experiments, the inventors produced a combustion reaction 302 that was apparently wholly contained in the perforations 210 between the input face 212 and the output face 214 of the perforated flame holder 102. According to an alternative interpretation, the perforated flame holder 102 can support combustion between the input face 212 and output face 214 when combustion is "time-averaged." For example, during transients, such as before the perforated flame holder 102 is fully heated, or if too high a (cooling) load is placed on the system, the combustion may travel somewhat downstream from the output face 214 of the perforated flame holder 102. Alternatively, if the cooling load is relatively low and/or the furnace temperature reaches a high level, the combustion may travel somewhat upstream of the input face 212 of the perforated flame holder 102.

While a "flame" is described in a manner intended for ease of description, it should be understood that in some instances, no visible flame is present. Combustion occurs primarily within the perforations 210, but the "glow" of combustion heat is dominated by a visible glow of the perforated flame holder 102 itself. In other instances, the inventors have noted transient "huffing" or "flashback" wherein a visible flame momentarily ignites in a region lying between the input face 212 of the perforated flame holder 102 and the fuel nozzle 218, within the dilution region $D_D$. Such transient huffing or flashback is generally short in duration such that, on a time-averaged basis, a majority of combustion occurs within the perforations 210 of the perforated flame holder 102, between the input face 212 and the output face 214. In still other instances, the inventors have noted apparent combustion occurring downstream from the output face 214 of the perforated flame holder 102, but still a majority of combustion occurred within the perforated flame holder 102 as evidenced by continued visible glow from the perforated flame holder 102 that was observed.

The perforated flame holder 102 can be configured to receive heat from the combustion reaction 302 and output a portion of the received heat as thermal radiation 304 to heat-receiving structures (e.g., furnace walls and/or radiant section working fluid tubes) in or adjacent to the combustion volume 204. As used herein, terms such as radiation, thermal radiation, radiant heat, heat radiation, etc. are to be construed as being substantially synonymous, unless further definition is provided. Specifically, such terms refer to blackbody-type radiation of electromagnetic energy, primarily at infrared wavelengths, but also at visible wavelengths owing to elevated temperature of the perforated flame holder body 208.

Referring especially to FIG. 3, the perforated flame holder 102 outputs another portion of the received heat to the fuel and oxidant mixture 206 received at the input face 212 of the perforated flame holder 102. The perforated flame holder body 208 may receive heat from the combustion reaction 302 at least in heat receiving regions 306 of perforation walls 308. Experimental evidence has suggested to the inventors that the position of the heat receiving regions 306, or at least the position corresponding to a maximum rate of receipt of heat, can vary along the length of the perforation walls 308. In some experiments, the location of maximum receipt of heat was apparently between ⅓ and ½ of the distance from the input face 212 to the output face 214 (i.e., somewhat nearer to the input face 212 than to the output face 214). The inventors contemplate that the heat receiving regions 306 may lie nearer to the output face 214 of the perforated flame holder 102 under other conditions. Most probably, there is no clearly defined edge of the heat receiving regions 306 (or for that matter, the heat output regions 310, described below). For ease of understanding, the heat receiving regions 306 and the heat output regions 310 will be described as particular regions 306, 310.

The perforated flame holder body 208 can be characterized by a heat capacity. The perforated flame holder body 208 may hold thermal energy from the combustion reaction 302 in an amount corresponding to the heat capacity multiplied by temperature rise, and transfer the thermal energy from the heat receiving regions 306 to heat output regions 310 of the perforation walls 308. Generally, the heat output regions 310 are nearer to the input face 212 than are the heat receiving regions 306. According to one interpretation, the perforated flame holder body 208 can transfer heat from the heat receiving regions 306 to the heat output regions 310 via thermal radiation, depicted graphically as 304. According to another interpretation, the perforated flame holder body 208 can transfer heat from the heat receiving regions 306 to the heat output regions 310 via heat conduction along heat conduction paths 312. The inventors contemplate that multiple heat transfer mechanisms including conduction, radiation, and possibly convection may be operative in transferring heat from the heat receiving regions 306 to the heat output regions 310. In this way, the perforated flame holder 102 may act as a heat source to maintain the combustion reaction 302, even under conditions where a combustion reaction 302 would not be stable when supported from a conventional flame holder.

The inventors believe that the perforated flame holder 102 causes the combustion reaction 302 to begin within thermal boundary layers 314 formed adjacent to walls 308 of the perforations 210. Insofar as combustion is generally understood to include a large number of individual reactions, and since a large portion of combustion energy is released within the perforated flame holder 102, it is apparent that at least a majority of the individual reactions occur within the perforated flame holder 102. As the relatively cool fuel and oxidant mixture 206 approaches the input face 212, the flow is split into portions that respectively travel through individual perforations 210. The hot perforated flame holder body 208 transfers heat to the fluid, notably within thermal boundary layers 314 that progressively thicken as more and more heat is transferred to the incoming fuel and oxidant mixture 206. After reaching a combustion temperature (e.g., the auto-ignition temperature of the fuel), the reactants continue to flow while a chemical ignition delay time elapses, over which time the combustion reaction 302 occurs. Accordingly, the combustion reaction 302 is shown as occurring within the thermal boundary layers 314. As flow progresses, the thermal boundary layers 314 merge at a merger point 316. Ideally, the merger point 316 lies between the input face 212 and output face 214 that define the ends of the perforations 210. At some position along the length of a perforation 210, the combustion reaction 302 outputs more heat to the perforated flame holder body 208 than it receives from the perforated flame holder body 208. The heat is received at the heat receiving region 306, is held by the perforated flame holder body 208, and is transported to the heat output region 310 nearer to the input face 212, where the heat is transferred into the cool reactants (and any included diluent) to bring the reactants to the ignition temperature.

In an embodiment, each of the perforations 210 is characterized by a length L defined as a reaction fluid propagation path length between the input face 212 and the output face 214 of the perforated flame holder 102. As used herein, the term reaction fluid refers to matter that travels through a perforation 210. Near the input face 212, the reaction fluid includes the fuel and oxidant mixture 206 (optionally including nitrogen, flue gas, and/or other "non-reactive" species). Within the combustion reaction region, the reaction fluid may include plasma associated with the combustion reaction 302, molecules of reactants and their constituent parts, any non-reactive species, reaction intermediates (including transition states), and reaction products. Near the output face 214, the reaction fluid may include reaction products and byproducts, non-reactive gas, and excess oxidant.

The plurality of perforations 210 can be each characterized by a transverse dimension D between opposing perforation walls 308. The inventors have found that stable combustion can be maintained in the perforated flame holder 102 if the length L of each perforation 210 is at least four times the transverse dimension D of the perforation. In other embodiments, the length L can be greater than six times the transverse dimension D. For example, experiments have been run where L is at least eight, at least twelve, at least sixteen, and at least twenty-four times the transverse dimension D. Preferably, the length L is sufficiently long for thermal boundary layers 314 to form adjacent to the perforation walls 308 in a reaction fluid flowing through the perforations 210 to converge at merger points 316 within the perforations 210 between the input face 212 and the output face 214 of the perforated flame holder 102. In experiments, the inventors have found L/D ratios between 12 and 48 to work well (i.e., produce low NOx, produce low CO, and maintain stable combustion).

The perforated flame holder body 208 can be configured to convey heat between adjacent perforations 210. The heat conveyed between adjacent perforations 210 can be selected to cause heat output from the combustion reaction portion 302 in a first perforation 210 to supply heat to stabilize a combustion reaction portion 302 in an adjacent perforation 210.

Referring especially to FIG. 2, the fuel and oxidant source 101 can further include a fuel nozzle 218, configured to output fuel, and an oxidant source 220 configured to output a fluid including the oxidant. For example, the fuel nozzle 218 can be configured to output pure fuel. The oxidant source 220 can be configured to output combustion air carrying oxygen, and optionally, flue gas.

The perforated flame holder 102 can be held by a perforated flame holder support structure 222 configured to hold the perforated flame holder 102 at a dilution distance $D_D$ away from the fuel nozzle 218. The fuel nozzle 218 can be configured to emit a fuel jet selected to entrain the oxidant to form the fuel and oxidant mixture 206 as the fuel jet and oxidant travel along a path to the perforated flame holder 102 through the dilution distance $D_D$ between the fuel nozzle 218 and the perforated flame holder 102. Additionally or alternatively (particularly when a blower is used to deliver oxidant contained in combustion air), the oxidant or combustion air source can be configured to entrain the fuel and the fuel and oxidant travel through the dilution distance $D_D$. In some embodiments, a flue gas recirculation path 224 can be provided. Additionally or alternatively, the fuel nozzle 218 can be configured to emit a fuel jet selected to entrain the oxidant and to entrain flue gas as the fuel jet travels through the dilution distance $D_D$ between the fuel nozzle 218 and the input face 212 of the perforated flame holder 102.

The fuel nozzle 218 can be configured to emit the fuel through one or more fuel orifices 226 having an inside diameter dimension that is referred to as "nozzle diameter." The perforated flame holder support structure 222 can support the perforated flame holder 102 to receive the fuel and oxidant mixture 206 at the distance $D_D$ away from the fuel nozzle 218 greater than 20 times the nozzle diameter. In another embodiment, the perforated flame holder 102 is disposed to receive the fuel and oxidant mixture 206 at the distance $D_D$ away from the fuel nozzle 218 between 100 times and 1100 times the nozzle diameter. Preferably, the perforated flame holder support structure 222 is configured to hold the perforated flame holder 102 at a distance about 200 times or more of the nozzle diameter away from the fuel nozzle 218. When the fuel and oxidant mixture 206 travels about 200 times the nozzle diameter or more, the mixture is sufficiently homogenized to cause the combustion reaction 302 to produce minimal NOx.

The fuel and oxidant source 101 can alternatively include a premix fuel and oxidant source, according to an embodiment. A premix fuel and oxidant source can include a premix chamber (not shown), a fuel nozzle configured to output fuel into the premix chamber, and an oxidant (e.g., combustion air) channel configured to output the oxidant into the premix chamber. A flame arrestor can be disposed between the premix fuel and oxidant source and the perforated flame holder 102 and be configured to prevent flame flashback into the premix fuel and oxidant source.

The oxidant source 220, whether configured for entrainment in the combustion volume 204 or for premixing, can include a blower configured to force the oxidant through the fuel and oxidant source 101.

The support structure 222 can be configured to support the perforated flame holder 102 from a floor or wall (not shown) of the combustion volume 204, for example. In another embodiment, the support structure 222 supports the perforated flame holder 102 from the fuel and oxidant source 101. Alternatively, the support structure 222 can suspend the perforated flame holder 102 from an overhead structure (such as a flue, in the case of an up-fired system). The support structure 222 can support the perforated flame holder 102 in various orientations and directions.

The perforated flame holder 102 can include a single perforated flame holder body 208. In another embodiment, the perforated flame holder 102 can include a plurality of adjacent perforated flame holder sections that collectively provide a tiled perforated flame holder 102.

The perforated flame holder support structure 222 can be configured to support the plurality of perforated flame holder sections. The perforated flame holder support structure 222 can include a metal superalloy, a cementatious, and/or ceramic refractory material. In an embodiment, the plurality of adjacent perforated flame holder sections can be joined with a fiber reinforced refractory cement.

The perforated flame holder 102 can have a width dimension W between opposite sides of the peripheral surface 216 at least twice a thickness dimension T between the input face 212 and the output face 214. In another embodiment, the perforated flame holder 102 can have a width dimension W between opposite sides of the peripheral surface 216 at least three times, at least six times, or at least nine times the thickness dimension T between the input face 212 and the output face 214 of the perforated flame holder 102.

In an embodiment, the perforated flame holder 102 can have a width dimension W less than a width of the combustion volume 204. This can allow the flue gas circulation path 224 from above to below the perforated flame holder 102 to lie between the peripheral surface 216 of the perforated flame holder 102 and the combustion volume wall (not shown).

Referring again to both FIGS. 2 and 3, the perforations 210 can be of various shapes. In an embodiment, the perforations 210 can include elongated squares, each having a transverse dimension D between opposing sides of the squares. In another embodiment, the perforations 210 can include elongated hexagons, each having a transverse dimension D between opposing sides of the hexagons. In yet another embodiment, the perforations 210 can include hollow cylinders, each having a transverse dimension D corresponding to a diameter of the cylinder. In another embodiment, the perforations 210 can include truncated cones or truncated pyramids (e.g., frustums), each having a transverse dimension D radially symmetric relative to a length axis that extends from the input face 212 to the output face 214. In some embodiments, the perforations 210 can each have a lateral dimension D equal to or greater than a quenching distance of the flame based on standard reference conditions. Alternatively, the perforations 210 may have lateral dimension D less then than a standard reference quenching distance.

In one range of embodiments, each of the plurality of perforations 210 has a lateral dimension D between 0.05 inch and 1.0 inch. Preferably, each of the plurality of perforations 210 has a lateral dimension D between 0.1 inch and 0.5 inch. For example the plurality of perforations 210 can each have a lateral dimension D of about 0.2 to 0.4 inch.

The void fraction of a perforated flame holder 102 is defined as the total volume of all perforations 210 in a section of the perforated flame holder 102 divided by a total volume of the perforated flame holder 102 including body 208 and perforations 210. The perforated flame holder 102 should have a void fraction between 0.10 and 0.90. In an embodiment, the perforated flame holder 102 can have a void fraction between 0.30 and 0.80. In another embodiment, the perforated flame holder 102 can have a void fraction of about 0.70. Using a void fraction of about 0.70 was found to be especially effective for producing very low NOx.

The perforated flame holder 102 can be formed from a fiber reinforced cast refractory material and/or a refractory material such as an aluminum silicate material. For example, the perforated flame holder 102 can be formed to include mullite or cordierite. Additionally or alternatively, the perforated flame holder body 208 can include a metal superalloy such as Inconel or Hastelloy. The perforated flame holder body 208 can define a honeycomb. Honeycomb is an industrial term of art that need not strictly refer to a hexagonal cross section and most usually includes cells of square cross section. Honeycombs of other cross sectional areas are also known.

The inventors have found that the perforated flame holder 102 can be formed from VERSAGRID® ceramic honeycomb, available from Applied Ceramics, Inc. of Doraville, S.C.

The perforations 210 can be parallel to one another and normal to the input and output faces 212, 214. In another embodiment, the perforations 210 can be parallel to one another and formed at an angle relative to the input and output faces 212, 214. In another embodiment, the perforations 210 can be non-parallel to one another. In another embodiment, the perforations 210 can be non-parallel to one another and non-intersecting. In another embodiment, the perforations 210 can be intersecting. The body 308 can be one piece or can be formed from a plurality of sections.

In another embodiment, which is not necessarily preferred, the perforated flame holder 102 may be formed from reticulated ceramic material. The term "reticulated" refers to a netlike structure. Reticulated ceramic material is often made by dissolving a slurry into a sponge of specified porosity, allowing the slurry to harden, and burning away the sponge and curing the ceramic.

In another embodiment, which is not necessarily preferred, the perforated flame holder 102 may be formed from a ceramic material that has been punched, bored or cast to create channels.

In another embodiment, the perforated flame holder 102 can include a plurality of tubes or pipes bundled together. The plurality of perforations 210 can include hollow cylinders and can optionally also include interstitial spaces between the bundled tubes. In an embodiment, the plurality of tubes can include ceramic tubes. Refractory cement can be included between the tubes and configured to adhere the tubes together. In another embodiment, the plurality of tubes can include metal (e.g., superalloy) tubes. The plurality of tubes can be held together by a metal tension member circumferential to the plurality of tubes and arranged to hold the plurality of tubes together. The metal tension member can include stainless steel, a superalloy metal wire, and/or a superalloy metal band.

The perforated flame holder body 208 can alternatively include stacked perforated sheets of material, each sheet having openings that connect with openings of subjacent and superjacent sheets. The perforated sheets can include perforated metal sheets, ceramic sheets and/or expanded sheets. In another embodiment, the perforated flame holder body 208 can include discontinuous packing bodies such that the perforations 210 are formed in the interstitial spaces between the discontinuous packing bodies. In one example, the discontinuous packing bodies include structured packing shapes. In another example, the discontinuous packing bodies include random packing shapes. For example, the discontinuous packing bodies can include ceramic Raschig ring, ceramic Berl saddles, ceramic Intalox saddles, and/or metal rings or other shapes (e.g. Super Raschig Rings) that may be held together by a metal cage.

The inventors contemplate various explanations for why burner systems including the perforated flame holder 102 provide such clean combustion.

According to an embodiment, the perforated flame holder 102 may act as a heat source to maintain a combustion reaction even under conditions where a combustion reaction would not be stable when supported by a conventional flame holder. This capability can be leveraged to support combustion using a leaner fuel-to-oxidant mixture than is typically feasible. Thus, according to an embodiment, at the point where the fuel stream 206 contacts the input face 212 of the perforated flame holder 102, an average fuel-to-oxidant ratio of the fuel stream 206 is below a (conventional) lower combustion limit of the fuel component of the fuel stream 206—lower combustion limit defines the lowest concentration of fuel at which a fuel and oxidant mixture 206 will burn when exposed to a momentary ignition source under normal atmospheric pressure and an ambient temperature of 25° C. (77° F.).

The perforated flame holder 102 and systems including the perforated flame holder 102 described herein were found to provide substantially complete combustion of CO (single digit ppm down to undetectable, depending on experimental conditions), while supporting low NOx. According to one interpretation, such a performance can be achieved due to a sufficient mixing used to lower peak flame temperatures (among other strategies). Flame temperatures tend to peak under slightly rich conditions, which can be evident in any diffusion flame that is insufficiently mixed. By sufficiently mixing, a homogenous and slightly lean mixture can be achieved prior to combustion. This combination can result in reduced flame temperatures, and thus reduced NOx formation. In one embodiment, "slightly lean" may refer to 3% $O_2$, i.e. an equivalence ratio of ~0.87. Use of even leaner mixtures is possible, but may result in elevated levels of $O_2$. Moreover, the inventors believe perforation walls 308 may act as a heat sink for the combustion fluid. This effect may alternatively or additionally reduce combustion temperatures and lower NOx.

According to another interpretation, production of NOx can be reduced if the combustion reaction 302 occurs over a very short duration of time. Rapid combustion causes the reactants (including oxygen and entrained nitrogen) to be exposed to NOx-formation temperature for a time too short for NOx formation kinetics to cause significant production of NOx. The time required for the reactants to pass through the perforated flame holder 102 is very short compared to a conventional flame. The low NOx production associated with perforated flame holder combustion may thus be related to the short duration of time required for the reactants (and entrained nitrogen) to pass through the perforated flame holder 102.

Figure 4:
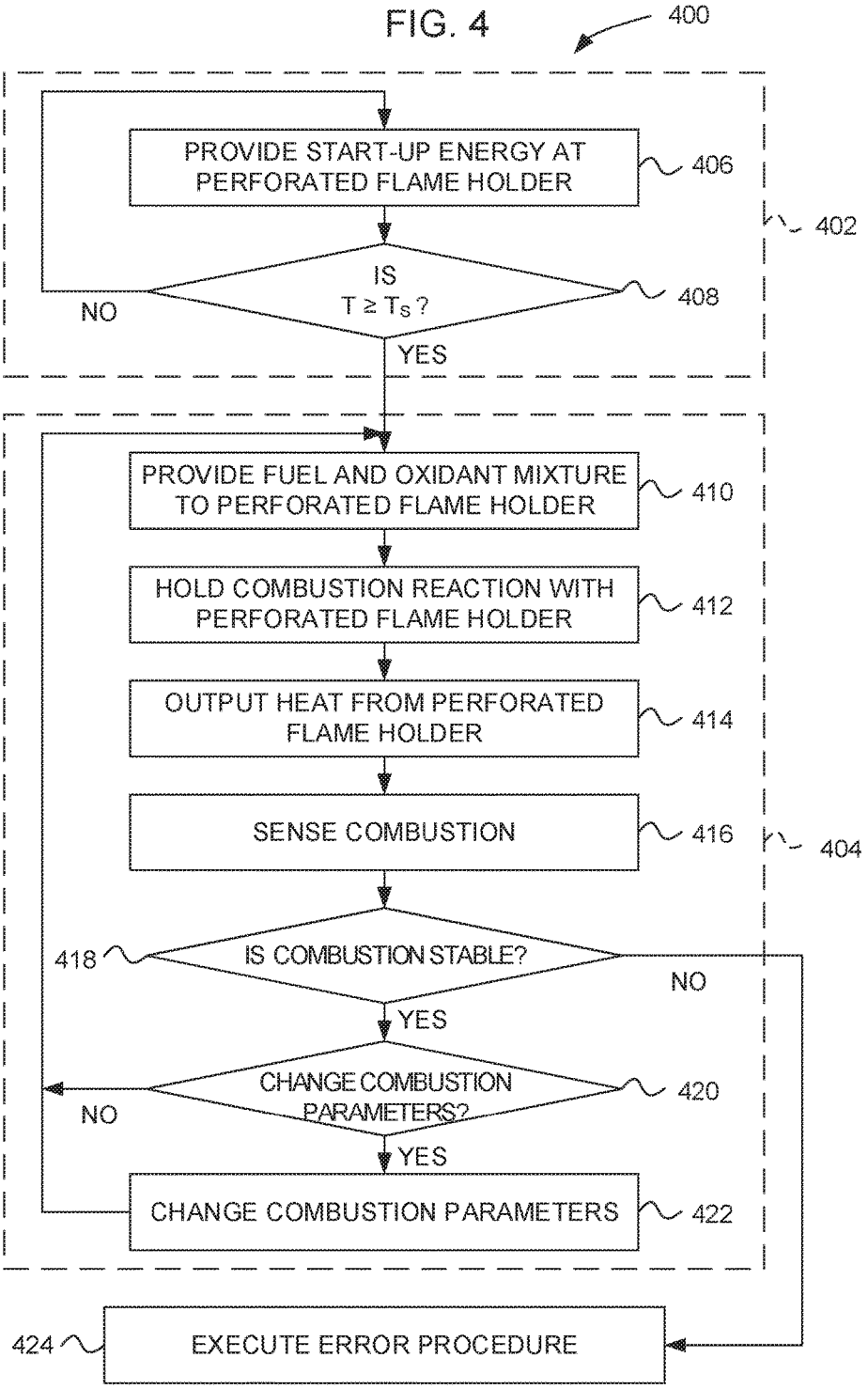
FIG. 4 is a flow diagram for a process for operating a combustion system including a perforated flame holder, according to an embodiment.

FIG. 4 is a flow chart showing a method 400 for operating a burner system including the perforated flame holder shown and described herein. To operate a burner system including a perforated flame holder, the perforated flame holder is first heated to a temperature sufficient to maintain combustion of the fuel and oxidant mixture.

According to a simplified description, the method 400 begins with step 402, wherein the perforated flame holder is preheated to a start-up temperature, $T_S$. After the perforated flame holder is raised to the start-up temperature, the method proceeds to step 404, wherein the fuel and oxidant are provided to the perforated flame holder and combustion is held by the perforated flame holder.

According to a more detailed description, step 402 begins with step 406, wherein start-up energy is provided at the perforated flame holder. Simultaneously or following providing start-up energy, a decision step 408 determines whether the temperature T of the perforated flame holder is at or above the start-up temperature, $T_S$. As long as the temperature of the perforated flame holder is below its start-up temperature, the method loops between steps 406 and 408 within the preheat step 402. In step 408, if the temperature T of at least a predetermined portion of the perforated flame holder is greater than or equal to the start-up temperature, the method 400 proceeds to overall step 404, wherein fuel and oxidant is supplied to and combustion is held by the perforated flame holder.

Step 404 may be broken down into several discrete steps, at least some of which may occur simultaneously.

Proceeding from step 408, a fuel and oxidant mixture is provided to the perforated flame holder, as shown in step 410. The fuel and oxidant may be provided by a fuel and oxidant source that includes a separate fuel nozzle and oxidant (e.g., combustion air) source, for example. In this approach, the fuel and oxidant are output in one or more directions selected to cause the fuel and oxidant mixture to be received by the input face of the perforated flame holder. The fuel may entrain the combustion air (or alternatively, the combustion air may dilute the fuel) to provide a fuel and oxidant mixture at the input face of the perforated flame holder at a fuel dilution selected for a stable combustion reaction that can be held within the perforations of the perforated flame holder.

Proceeding to step 412, the combustion reaction is held by the perforated flame holder.

In step 414, heat may be output from the perforated flame holder. The heat output from the perforated flame holder may be used to power an industrial process, heat a working fluid, generate electricity, or provide motive power, for example.

In optional step 416, the presence of combustion may be sensed. Various sensing approaches have been used and are contemplated by the inventors. Generally, combustion held by the perforated flame holder is very stable and no unusual sensing requirement is placed on the system. Combustion sensing may be performed using an infrared sensor, a video sensor, an ultraviolet sensor, a charged species sensor, thermocouple, thermopile, flame rod, and/or other combustion sensing apparatuses. In an additional or alternative variant of step 416, a pilot flame or other ignition source may be provided to cause ignition of the fuel and oxidant mixture in the event combustion is lost at the perforated flame holder.

Proceeding to decision step 418, if combustion is sensed not to be stable, the method 400 may exit to step 424, wherein an error procedure is executed. For example, the error procedure may include turning off fuel flow, re-executing the preheating step 402, outputting an alarm signal, igniting a stand-by combustion system, or other steps. If, in step 418, combustion in the perforated flame holder is determined to be stable, the method 400 proceeds to decision step 420, wherein it is determined if combustion parameters should be changed. If no combustion parameters are to be changed, the method loops (within step 404) back to step 410, and the combustion process continues. If a change in combustion parameters is indicated, the method 400 proceeds to step 422, wherein the combustion parameter change is executed. After changing the combustion parameter(s), the method loops (within step 404) back to step 410, and combustion continues.

Combustion parameters may be scheduled to be changed, for example, if a change in heat demand is encountered. For example, if less heat is required (e.g., due to decreased electricity demand, decreased motive power requirement, or lower industrial process throughput), the fuel and oxidant flow rate may be decreased in step 422. Conversely, if heat demand is increased, then fuel and oxidant flow may be increased. Additionally or alternatively, if the combustion system is in a start-up mode, then fuel and oxidant flow may be gradually increased to the perforated flame holder over one or more iterations of the loop within step 404.

Referring again to FIG. 2, the burner system 200 includes a heater 228 operatively coupled to the perforated flame holder 102. As described in conjunction with FIGS. 3 and 4, the perforated flame holder 102 operates by outputting heat to the incoming fuel and oxidant mixture 206. After combustion is established, this heat is provided by the combustion reaction 302; but before combustion is established, the heat is provided by the heater 228.

Various heating apparatuses have been used and are contemplated by the inventors. In some embodiments, the heater 228 can include a flame holder configured to support a flame disposed to heat the perforated flame holder 102. The fuel and oxidant source 101 can include a fuel nozzle 218 configured to emit a fuel stream 206 and an oxidant source 220 configured to output oxidant (e.g., combustion air) adjacent to the fuel stream 206. The fuel nozzle 218 and oxidant source 220 can be configured to output the fuel stream 206 to be progressively diluted by the oxidant (e.g., combustion air). The perforated flame holder 102 can be disposed to receive a diluted fuel and oxidant mixture 206 that supports a combustion reaction 302 that is stabilized by the perforated flame holder 102 when the perforated flame holder 102 is at an operating temperature. A start-up flame holder, in contrast, can be configured to support a start-up flame at a location corresponding to a relatively unmixed fuel and oxidant mixture that is stable without stabilization provided by the heated perforated flame holder 102.

The burner system 200 can further include a controller 103 operatively coupled to the heater 228 and to a data interface 232. For example, the controller 103 can be configured to control a start-up flame holder actuator configured to cause the start-up flame holder to hold the start-up flame when the perforated flame holder 102 needs to be pre-heated and to not hold the start-up flame when the perforated flame holder 102 is at an operating temperature (e.g., when $T \geq T_S$).

Various approaches for actuating a start-up flame are contemplated. In one embodiment, the start-up flame holder includes a mechanically-actuated bluff body configured to be actuated to intercept the fuel and oxidant mixture 206 to cause heat-recycling and/or stabilizing vortices and thereby hold a start-up flame; or to be actuated to not intercept the fuel and oxidant mixture 206 to cause the fuel and oxidant mixture 206 to proceed to the perforated flame holder 102. In another embodiment, a fuel control valve, blower, and/or damper may be used to select a fuel and oxidant mixture flow rate that is sufficiently low for a start-up flame to be jet-stabilized; and upon reaching a perforated flame holder 102 operating temperature, the flow rate may be increased to "blow out" the start-up flame. In another embodiment, the heater 228 may include an electrical power supply operatively coupled to the controller 103 and configured to apply an electrical charge or voltage to the fuel and oxidant mixture 206. An electrically conductive start-up flame holder may be selectively coupled to a voltage ground or other voltage selected to attract the electrical charge in the fuel and oxidant mixture 206. The attraction of the electrical charge was found by the inventors to cause a start-up flame to be held by the electrically conductive start-up flame holder.

In another embodiment, the heater 228 may include an electrical resistance heater configured to output heat to the perforated flame holder 102 and/or to the fuel and oxidant mixture 206. The electrical resistance heater can be configured to heat up the perforated flame holder 102 to an operating temperature. The heater 228 can further include a power supply and a switch operable, under control of the controller 103, to selectively couple the power supply to the electrical resistance heater.

An electrical resistance heater 228 can be formed in various ways. For example, the electrical resistance heater 228 can be formed from KANTHAL® wire (available from Sandvik Materials Technology division of Sandvik AB of Hallstaham mar, Sweden) threaded through at least a portion of the perforations 210 defined by the perforated flame holder body 208. Alternatively, the heater 228 can include an inductive heater, a high-energy beam heater (e.g. microwave or laser), a frictional heater, electro-resistive ceramic coatings, or other types of heating technologies.

Other forms of start-up apparatuses are contemplated. For example, the heater 228 can include an electrical discharge igniter or hot surface igniter configured to output a pulsed ignition to the oxidant and fuel. Additionally or alternatively, a start-up apparatus can include a pilot flame apparatus disposed to ignite the fuel and oxidant mixture 206 that would otherwise enter the perforated flame holder 102. The electrical discharge igniter, hot surface igniter, and/or pilot flame apparatus can be operatively coupled to the controller 103, which can cause the electrical discharge igniter or pilot flame apparatus to maintain combustion of the fuel and oxidant mixture 206 in or upstream from the perforated flame holder 102 before the perforated flame holder 102 is heated sufficiently to maintain combustion.

The burner system 200 can further include a sensor 234 operatively coupled to the control circuit 103. The sensor 234 can include a heat sensor configured to detect infrared radiation or a temperature of the perforated flame holder 102. The control circuit 103 can be configured to control the heating apparatus 228 responsive to input from the sensor 234. Optionally, a fuel control valve 236 can be operatively coupled to the controller 103 and configured to control a flow of fuel to the fuel and oxidant source 101. Additionally or alternatively, an oxidant blower or damper 238 can be operatively coupled to the controller 103 and configured to control flow of the oxidant (or combustion air).

The sensor 234 can further include a combustion sensor operatively coupled to the control circuit 103, the combustion sensor being configured to detect a temperature, video image, and/or spectral characteristic of a combustion reaction 302 held by the perforated flame holder 102. The fuel control valve 236 can be configured to control a flow of fuel from a fuel source to the fuel and oxidant source 202. The controller 103 can be configured to control the fuel control valve 236 responsive to input from the combustion sensor 234. The controller 103 can be configured to control the fuel control valve 236 and/or oxidant blower or damper to control a preheat flame type of heater 228 to heat the perforated flame holder 102 to an operating temperature. The controller 103 can similarly control the fuel control valve 236 and/or the oxidant blower or damper to change the fuel and oxidant mixture 206 flow responsive to a heat demand change received as data via the data interface 232.

Figure 5A:
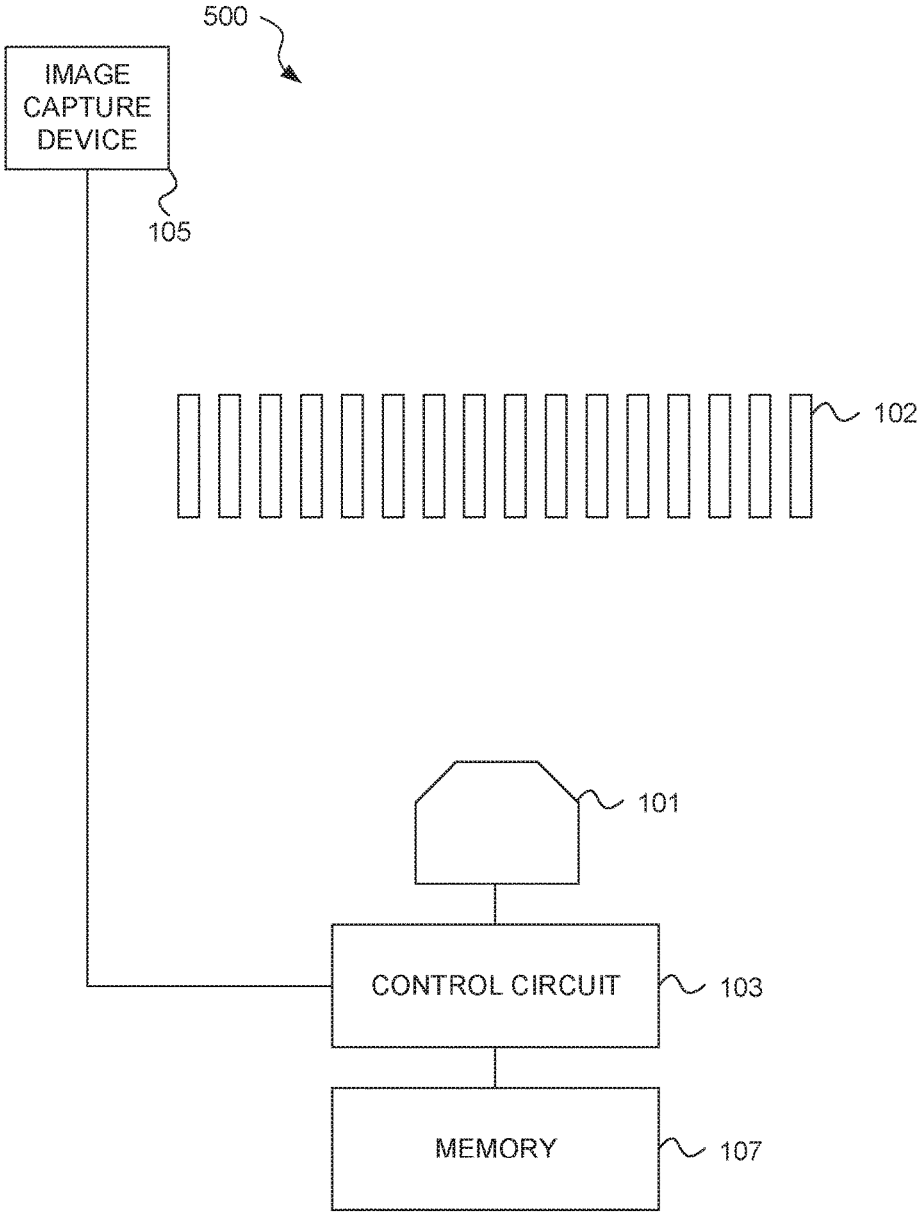
FIG. 5A is a diagram of a combustion system including a perforated flame holder and an image capture device, according to an embodiment.

FIG. 5A is a diagram of a combustion system 500, according to an embodiment. The combustion system 500 includes a fuel and oxidant source 101, a perforated flame holder 102, a control circuit 103, an image capture device 105, and a memory 107.

According to an embodiment, the fuel and oxidant source 101 includes, for example, a fuel nozzle configured to output fuel and oxidant onto the perforated flame holder 102. The perforated flame holder 102 sustains a combustion reaction of the fuel and oxidant primarily within the perforated flame holder 102. The control circuit 103 is configured to cause the image capture device 105 to capture one or more images of the combustion reaction. In one embodiment, the control circuit is further configured to analyze the one or more images and to adjust the characteristics of the combustion reaction based on the analysis of the one or more images.

Figure 5B:
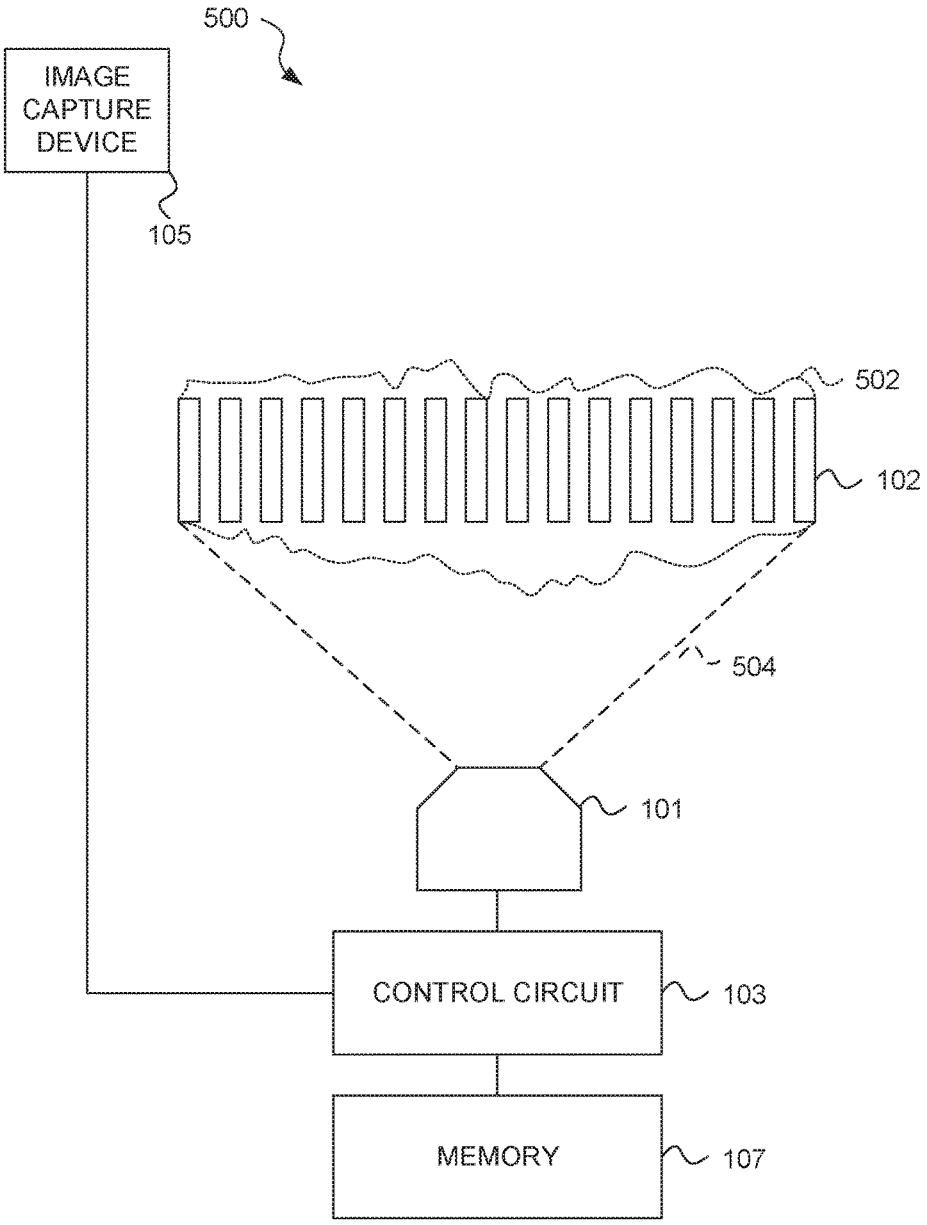
FIGS. 5B-5D are diagrams of a combustion system including a combustion reaction in various positions, according to an embodiment.

In FIG. 5B the fuel and oxidant source 101 is outputting fuel and oxidant 504 onto the perforated flame holder 102, according to an embodiment. The perforated flame holder 102 holds a combustion reaction 502 of the fuel and oxidant 504. The image capture device 105 captures an image of the combustion reaction 502 in the position shown in FIG. 5B. In FIG. 5B the combustion reaction 502 is mostly confined within the perforations of the perforated flame holder 102. However, a portion of the combustion reaction 502 is below the perforated flame holder 102 and a portion of the combustion reaction 502 is above the perforated flame holder 102. The image capture device 105 outputs the captured image of the combustion reaction 502 to the control circuit 103. The control circuit 103 stores the captured image in the memory 107.

Figure 5C:
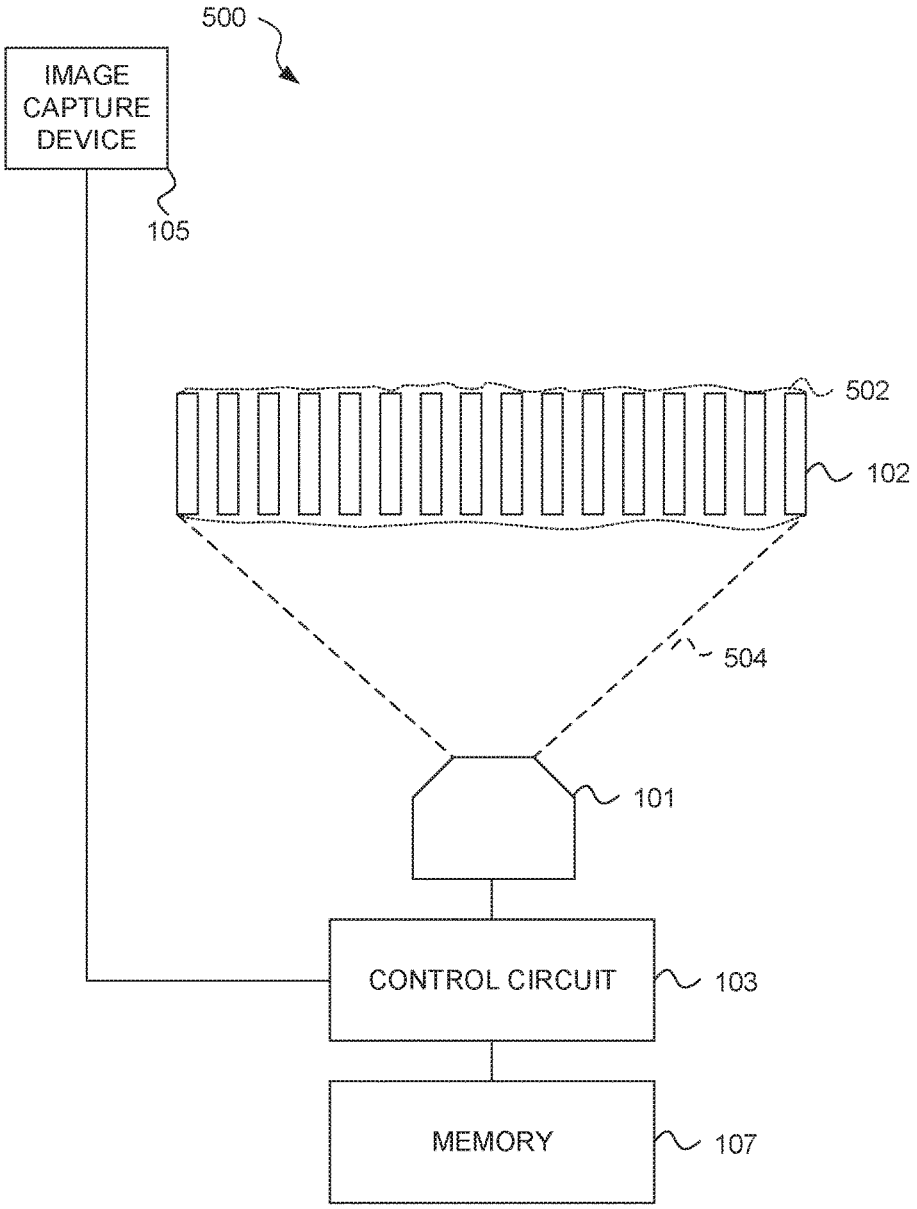

In FIG. 5C the fuel and oxidant source 101 is outputting fuel and oxidant 504 onto the perforated flame holder 102. The perforated flame holder 102 holds a combustion reaction 502 of the fuel and oxidant 504. The image capture device 105 captures an image of the combustion reaction 502 in the position shown in FIG. 5C. In FIG. 5C the combustion reaction 502 is mostly confined within the perforations of the perforated flame holder 102. A smaller portion of the combustion reaction 502 is below the perforated flame holder 102 than in FIG. 5B. The image capture device 105 outputs the captured image of the combustion reaction 502 to the control circuit 103. The control circuit 103 stores the captured image in the memory 107.

Figure 5D:
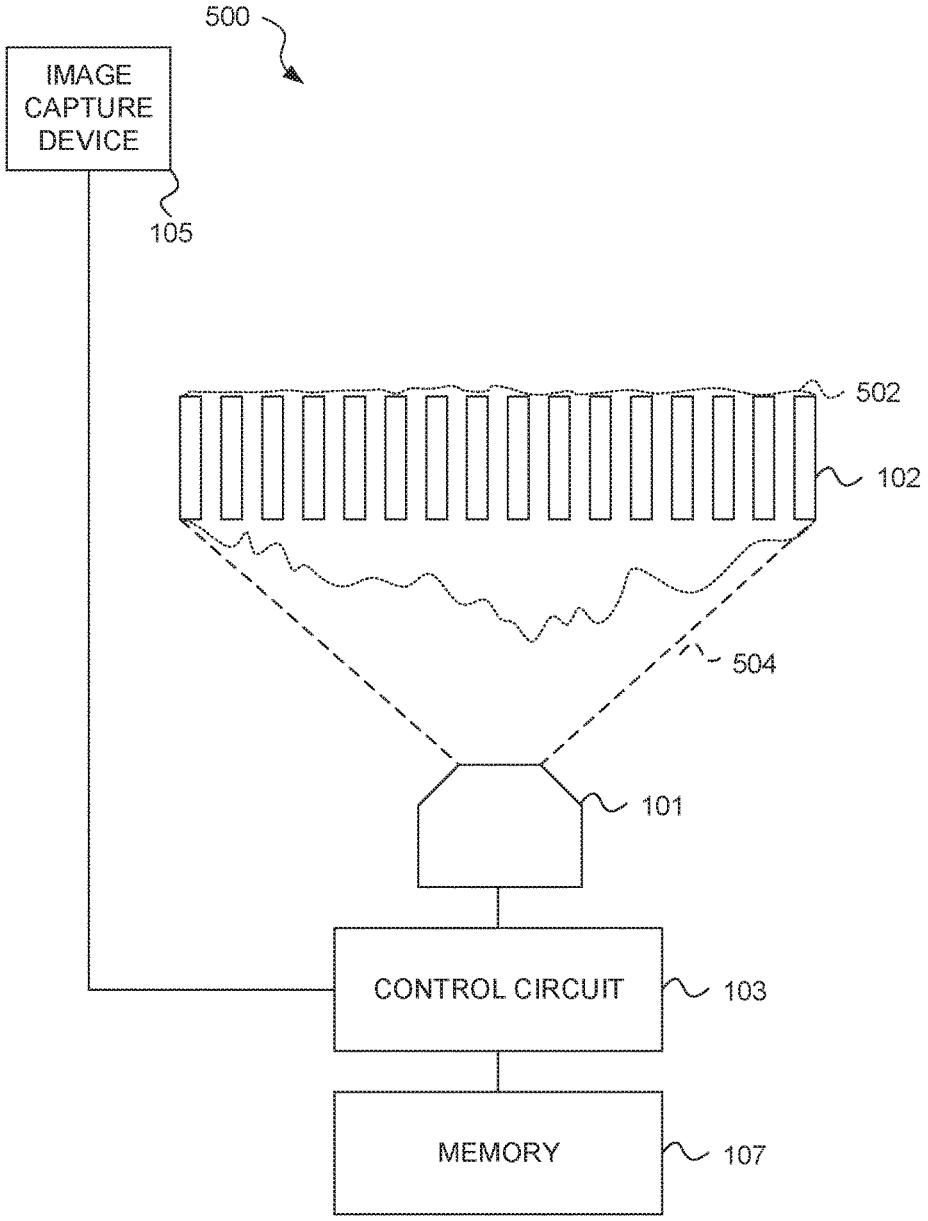

In FIG. 5D the fuel and oxidant source 101 is outputting fuel and oxidant 504 onto the perforated flame holder 102, according to an embodiment. The perforated flame holder 102 holds a combustion reaction 502 of the fuel and oxidant 504. The image capture device 105 captures an image of the combustion reaction 502 in the position shown in FIG. 5D. In FIG. 5D the combustion reaction 502 is mostly confined within the perforations of the perforated flame holder 102. A larger portion of the combustion reaction 502 is below the perforated flame holder 102 than in FIG. 5B, 5C. The image capture device 105 outputs the captured image of the combustion reaction 502 to the control circuit 103. The control circuit 103 stores the captured image in the memory 107.

Figure 5E:
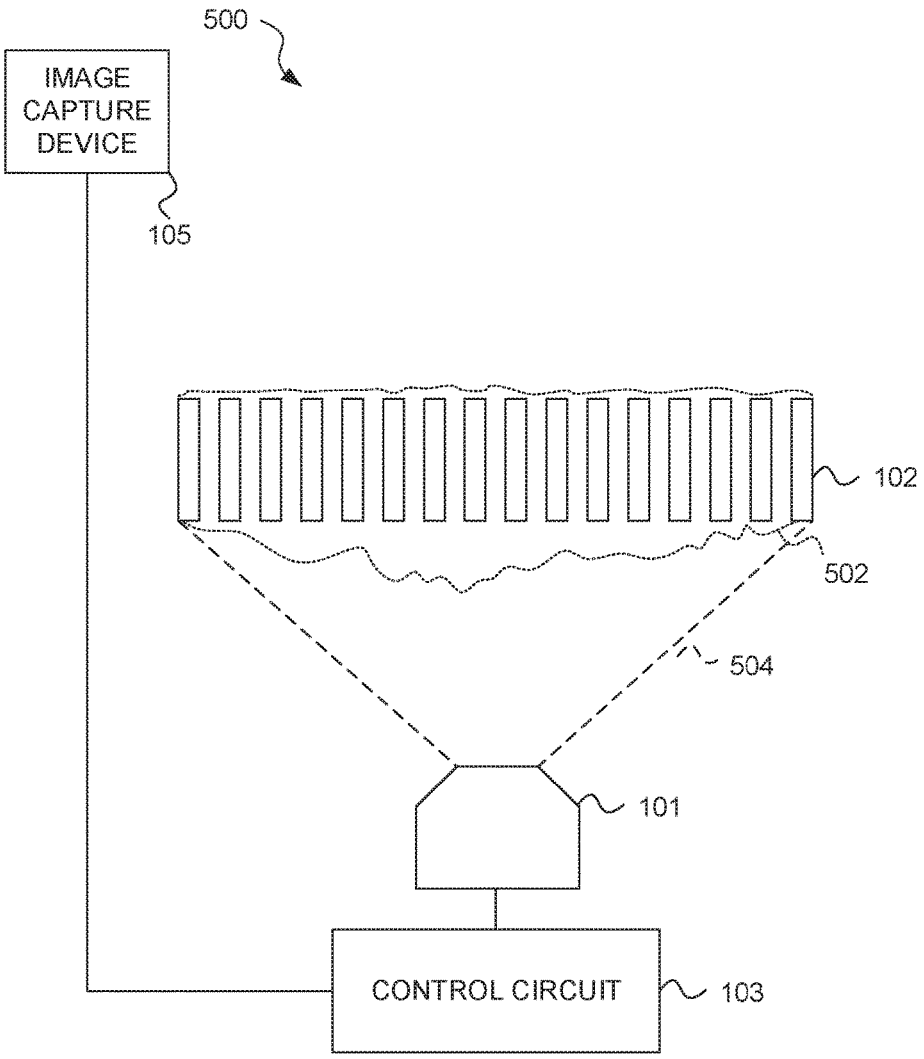
FIG. 5E is an illustration of an averaged image of the combustion reaction from FIGS. 5B-5D, according to an embodiment.

FIG. 5E is an averaged image 506 of the combustion reaction 502 produced from the combustion reaction 102 images of FIGS. 5B-5D, according to one embodiment. The control circuit 103 receives the images of the combustion reaction 502 corresponding to FIGS. 5B-5D from the image capture device 105. The control circuit 103 produces from the images of the combustion reaction 502 the averaged image 506 of the combustion reaction 502 shown in dashed lines in FIG. 5E. The averaged image 506 of the combustion reaction 502 shows the average position of the combustion reaction 502 from the images captured by the camera 105.

While the averaged image 506 has been described as being produced from three images of the combustion reaction 502, in practice the averaged image 506 can be produced from dozens or hundreds of images of the combustion reaction 502.

After the averaged image 506 has been produced, the control circuit 103 compares the averaged image 506 to one or more reference images stored in the memory 107. The reference images can correspond to particular target combustion reaction 502 profiles that can be selected for the combustion reaction 502.

While FIGS. 5A-5E have disclosed an embodiment in which the image capture device 105 captures a visible spectrum image that indicates the position of the combustion reaction 502 with respect to the perforated flame holder 102, the image capture device 105 can capture other types of images to provide indications of other characteristics of the combustion reaction 502. For example, the image capture device 105 can capture an image that indicates heat or temperature distributions of the combustion reaction, the perforated flame holder 102, and the fuel and oxidant 504. If the captured image indicates that the fuel and oxidant below the perforated flame holder 102 are very hot, this can indicate that the fuel and oxidant will soon combust below the perforated flame holder 102 rather than within the perforated flame holder 102. In this case, the control circuit 103, or a technician, can cause the fuel and oxidant source 101 to alter the output of fuel and oxidant 504 in such a way to reduce the heat of the fuel and oxidant below the perforated flame holder 102. Alternatively, the captured image can indicate that the perforated flame holder 102 is not evenly heated i.e. that the combustion reaction 502 now be taking place within some portions of the perforated flame holder 102. This can indicate that the fuel and oxidant are not being evenly distributed into the perforated flame holder 102. In response, the control circuit 103, or a technician, can adjust the output of fuel and oxidant from the fuel and oxidant source 101. Alternatively, the captured image can indicate that the combustion reaction is very blue near the top of the perforated flame holder 102. This can be an indication that a significant portion of the combustion reaction 504 is occurring above the perforated flame holder 102 in the form of blue flame, or that the perforated flame holder 102 is too hot. Accordingly, the control circuit 103 or technician can adjust the output of fuel and oxidant 504 from the fuel and oxidant source 101 to adjust the combustion reaction 502. In one embodiment, the control circuit 103 can adjust the combustion reaction 502 by reducing the heat load, for example by reducing water flow to steam tubes. In one embodiment the fuel and oxidant source 101 can include one or more fuel nozzles each having one or more orifices. The control circuit 103 can reduce fuel velocity by switching to larger orifice nozzles or by outputting the same amount of fuel through more nozzles. In one embodiment the control circuit can change the fuel mix to a higher speed fuel, for example by adding hydrogen.

According to an embodiment, the one or more images can indicate that the combustion reaction 502 is closer than desired to the fuel and oxidant source 101. In some cases that can be tolerable. In other cases the control circuit 103 will adjust the output of the fuel and oxidant 504 to cause the combustion reaction 502 to retract from the fuel and oxidant source 101, for example by increasing fuel velocity or by switching to a fuel mixture having a lower flame speed. Alternatively, the fuel control circuit 103 can shut off the output of the fuel from the fuel and oxidant source 101 to stop the combustion reaction entirely.

Figure 6A:
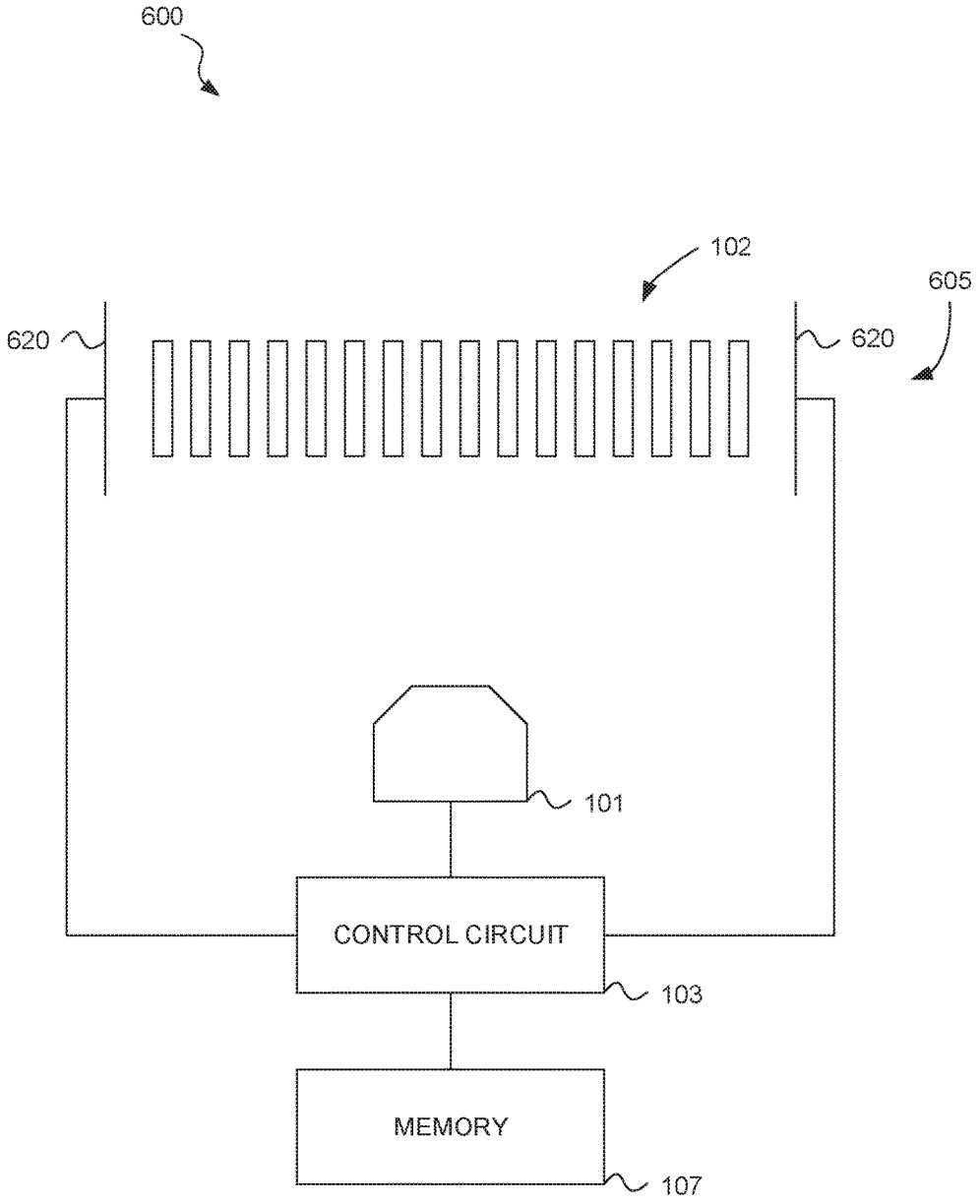
FIG. 6A is a diagram of a combustion system including a perforated flame holder and an electrocapacitive tomography system, according to an embodiment.

FIG. 6A is a diagram of a combustion system 600, according to an embodiment. The combustion system 600 includes a fuel and oxidant source 101, a perforated flame holder 102, a control circuit 103, an electrocapacitive tomography device 605, and a memory 107.

According to an embodiment, the fuel and oxidant source 101 includes, for example, a fuel nozzle configured to output fuel and oxidant onto the perforated flame holder 102. The perforated flame holder 102 sustains a combustion reaction of the fuel and oxidant primarily within the perforated flame holder 102.

According to an embodiment, the electrocapacitive tomography device 605 is an image capture device that includes a plurality of electrodes 620 positioned at selected locations adjacent to the perforated flame holder 102. The electrocapacitive tomography device 605 is configured to make images of the perforated flame holder 102 based on the capacitance between the electrodes 620. The images represent slices of the perforated flame holder 102 based on the capacitances between the electrodes 620. The capacitance between pairs of electrodes 620 depends, in part, on the dielectric constant of the material(s) between the pairs of electrodes 620. In particular, the dielectric constant within the perforations of the perforated flame holder 102 can change based on the characteristics of the combustion reaction within the perforations. Therefore, the images produced by the electrical tomography device 605 can give an indication of a temperature within the perforations or a concentration or flow of fuel, oxidant, and flue gasses at various locations in the perforated flame holder 102 based on the dielectric constant at the various locations of the perforated flame holder 102. The control circuit 103 can analyze the images and adjust the combustion reaction based on the images.

According to an embodiment, the control circuit 103 is configured to cause the electrocapacitive tomography device 605 to capture one or more images of the combustion reaction. In one embodiment, the control circuit 103 is further configured to analyze the one or more images and to adjust the characteristics of the combustion reaction based on the analysis of the one or more images.

Figure 6B:
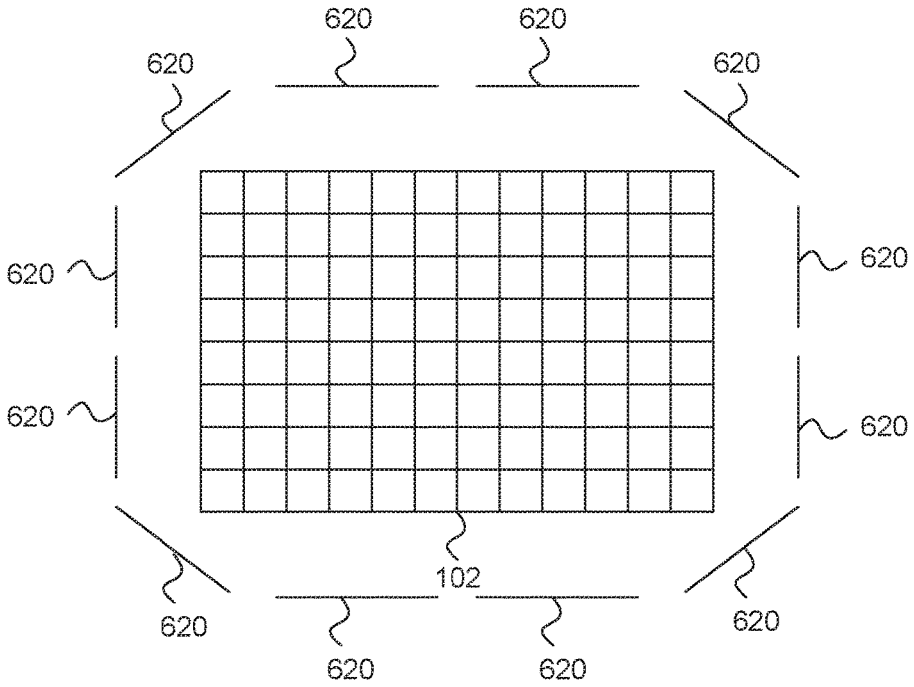
FIG. 6B is a top view of the perforated flame holder and the electrocapacitive tomography system, according to an embodiment.

FIG. 6B is a top view of the perforated flame holder 102 and the electrocapacitive tomography device 605, according to an embodiment. The electrocapacitive tomography device 605 includes multiple pairs of electrodes 620 positioned laterally around the perforated flame holder 102. Each pair of electrodes 620 includes two electrodes 620 directly facing each other. The control circuit 103 controls each pair of electrodes 620 to make a plurality of images of the perforated flame holder 102, according to an embodiment.

Figure 7A:
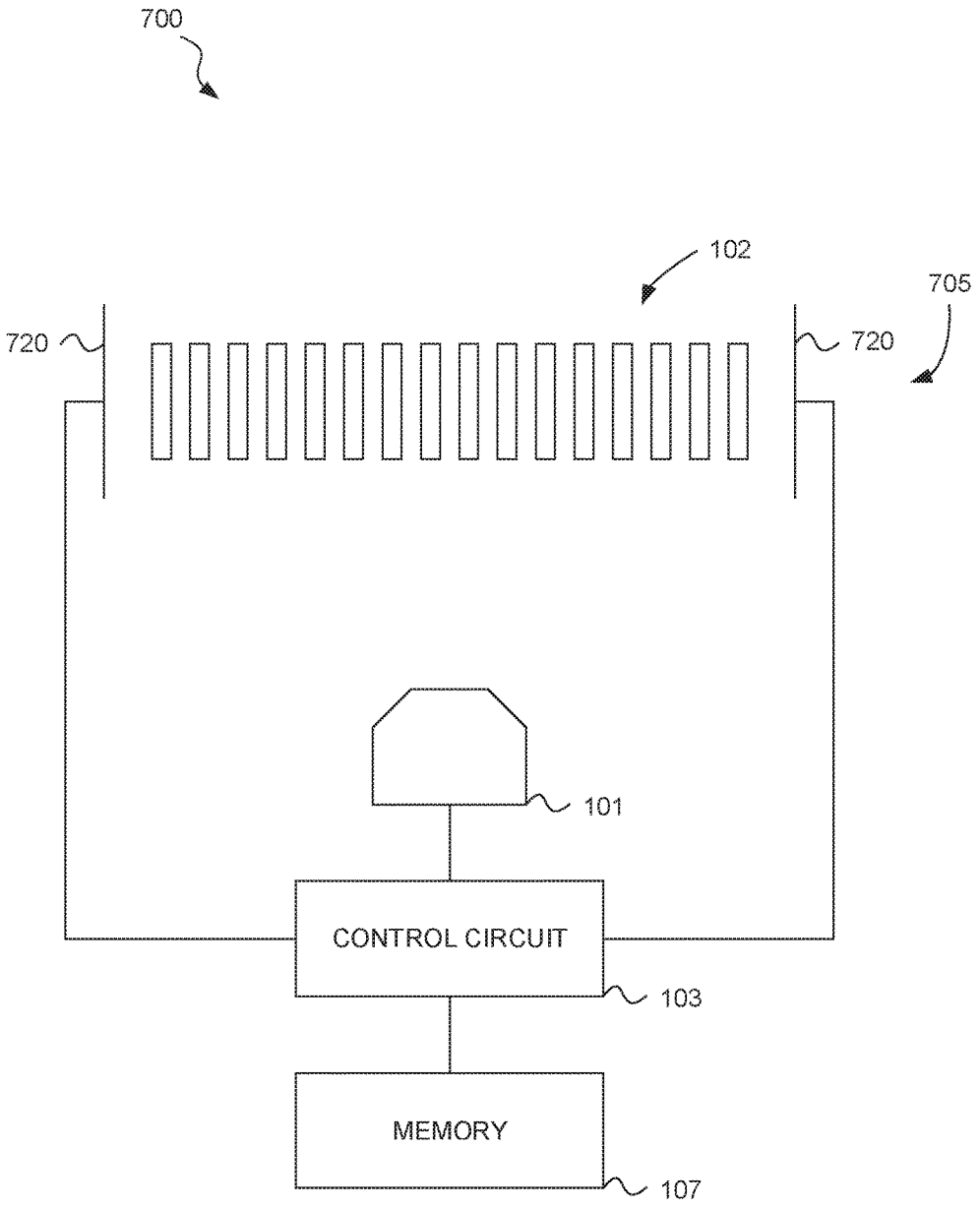
FIG. 7A is a diagram of a combustion system including a perforated flame holder and an electromagnetic induction tomography system, according to an embodiment.

FIG. 7A is a diagram of a combustion system 700, according to an embodiment. The combustion system 700 includes a fuel and oxidant source 101, a perforated flame holder 102, a control circuit 103, a magnetic-inductive tomography device 705, and a memory 107.

According to an embodiment, the fuel and oxidant source 101 includes, for example, a fuel nozzle configured to output fuel and oxidant onto the perforated flame holder 102. The perforated flame holder 102 sustains a combustion reaction of the fuel and oxidant primarily within the perforated flame holder 102.

According to an embodiment, the electromagnetic induction tomography device 705 is an image capture device that includes a plurality of inductor coils 720 positioned at selected locations adjacent to the perforated flame holder 102. The electromagnetic induction tomography device 705 is configured to make images of the perforated flame holder 102 based on induction characteristics between pairs of inductor coils 720. In particular, each pair of inductor coils 720 includes an excitation coil and the sensing coil. The excitation coil is excited to generate a magnetic field. The magnetic field induces eddy currents within the perforations of the perforated flame holder 102 or within the body of the perforated flame holder 102. The sensing coil detects the eddy currents by sensing magnetic fields generated by the eddy currents. The eddy currents are dependent, in part, on the conductivity, permittivity, and permeability of the material(s) between the pairs of inductor coils 720. The conductivity, permittivity, and permeability of the material(s) within the perforations of the perforated flame holder 102 can change based on the characteristics of the combustion reaction within the perforations. Therefore, the images produced by the electromagnetic induction tomography device 705 can give an indication of a temperature within the perforations or a concentration or flow of fuel, oxidant, and flue gasses at various locations in the perforated flame holder 102 based on the dielectric constant at the various locations of the perforated flame holder 102. The control circuit 103 can analyze the images and adjust the combustion reaction based on the images.

According to an embodiment, the control circuit 103 is configured to cause the electromagnetic induction tomography device 705 to capture one or more images of the combustion reaction. In one embodiment, the control circuit 103 is further configured to analyze the one or more images and to adjust the characteristics of the combustion reaction based on the analysis of the one or more images.

While FIG. 7A shows only a single wire connected between each inductor coil 720 and the control circuit 103, in practice two wires may be coupled between each inductor coil and the control circuit 103. This is because each could may include two terminals.

Figure 7B:
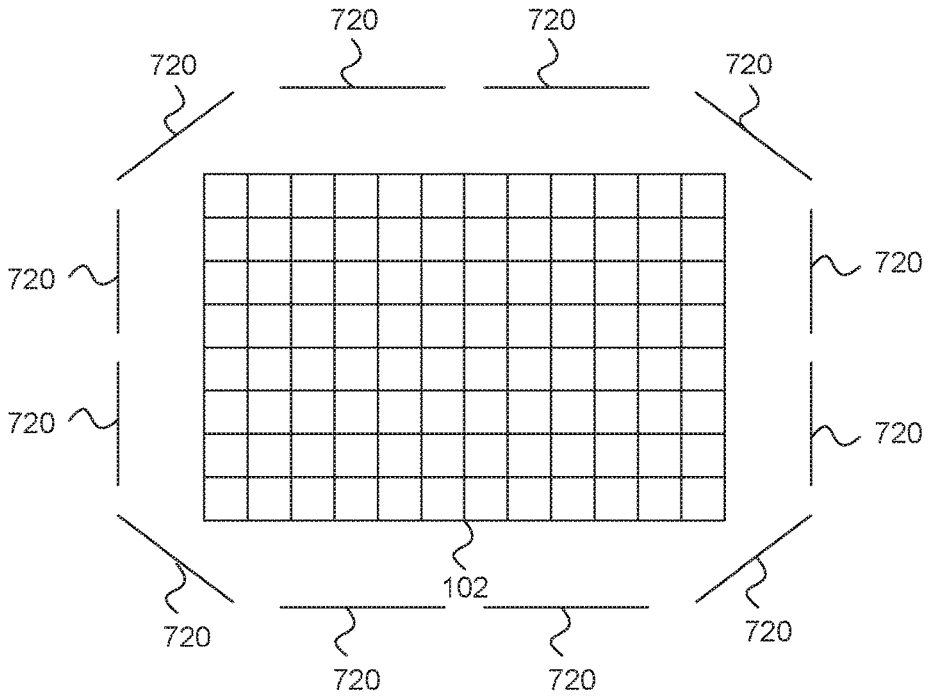
FIG. 7B is a top view of the perforated flame holder and the electromagnetic induction tomography system, according to an embodiment.

FIG. 7B is a top view of the perforated flame holder 102 and the electromagnetic induction tomography device 705, according to an embodiment. The electromagnetic induction tomography device 705 includes multiple pairs of inductor coils 720 positioned laterally around the perforated flame holder 102. Each pair of inductor coils 720 includes two inductor coils 720 directly facing each other. In each pair of inductor coils 720, one inductor coil 720 acts as an excitation coil and the other inductor coil 720 acts as a sensing coil. The control circuit 103 controls each pair of inductor coils 720 to make a plurality of images of the perforated flame holder 102, according to an embodiment.

Figure 7C:
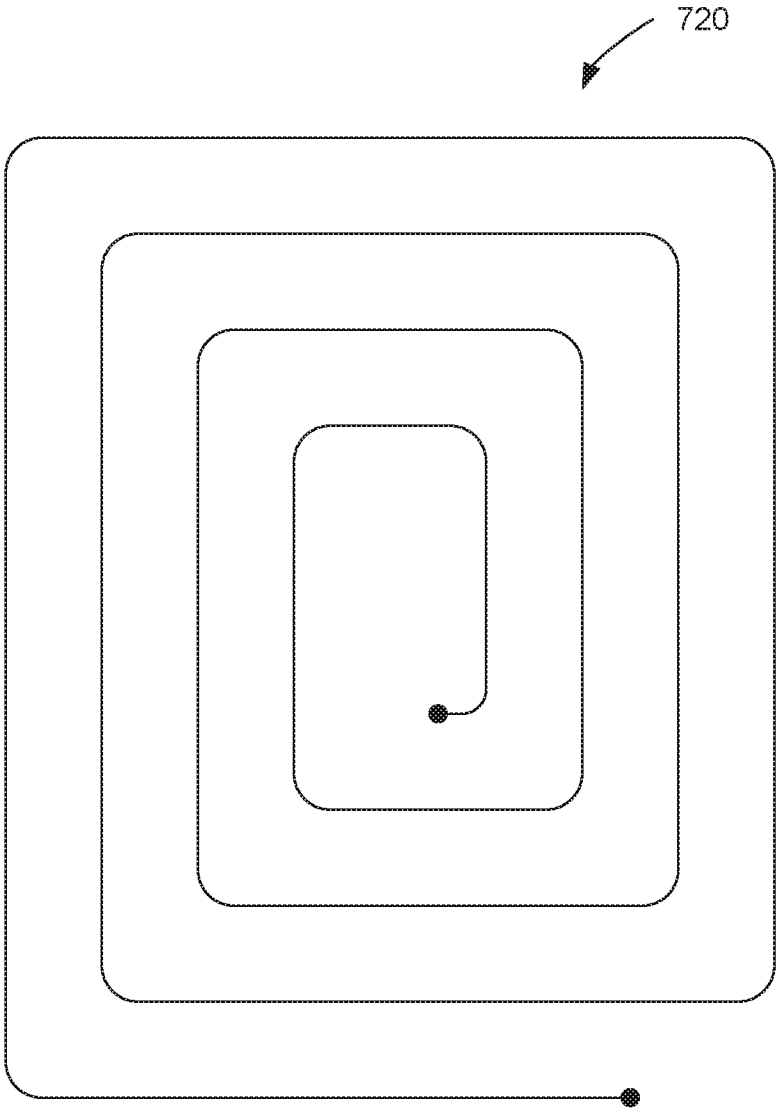
FIG. 7C is a side view of an inductor coil of the electromagnetic induction tomography device, according to an embodiment.

FIG. 7C is a side view of an inductor coil 720 of the electromagnetic induction tomography device 705, according to an embodiment. The inductor coils 720 include a conductive wire or other conductive material with several windings and two terminals. Each terminal is connected to the control circuit 103.

Figure 8A:
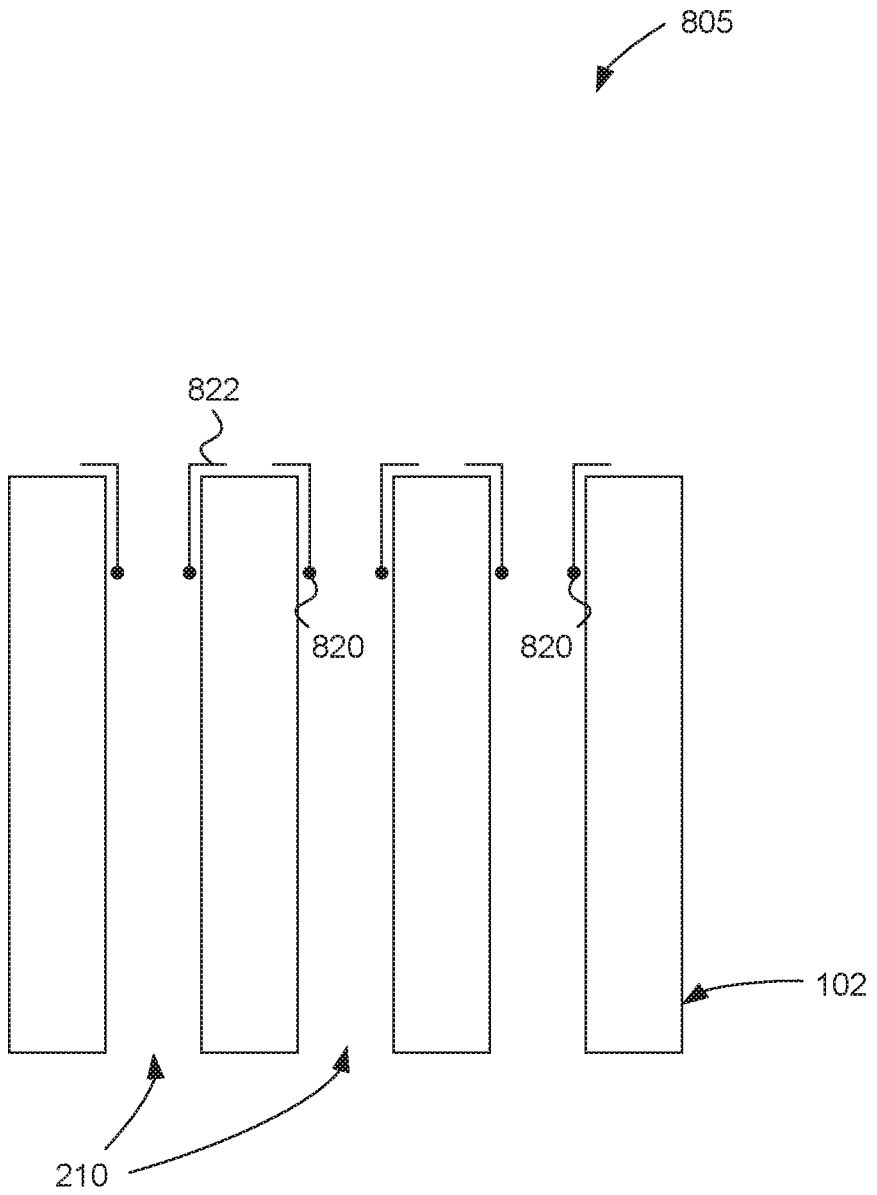
FIG. 8A is an enlarged side-sectional view of a portion of a perforated flame holder and an electroresistive tomography system, according to an embodiment.

FIG. 8A is a side sectional view of a portion of a perforated flame holder 102 and an electroresistive tomography device 805, according to an embodiment.

According to an embodiment, the electroresistive tomography device 805 is an image capture device that can include a plurality of electrodes 820 positioned within the perforations of the perforated flame holder 102. A pair of electrodes 820 is positioned within each perforation 210 of the perforated flame holder 102. Each electrode 820 may be coupled to a conductive wire 822. The electroresistive tomography device 805 is configured to make images of the perforated flame holder 102 based on the resistance between pairs of electrodes 820. The control circuit 103 applies a voltage between each pair of electrodes 820. The electroresistive image capture device 805 makes a plurality of images based on the resistances of the materials within the perforations 210. The resistance of the materials within the perforations 210 can change based on the characteristics of the combustion reaction within the perforations 210. Therefore, the images produced by the electroresistive tomography device 805 can give an indication of a temperature within the perforations 210 or a concentration or flow of fuel, oxidant, and flue gasses at various locations in the perforated flame holder 102 based on the resistance at the various locations of the perforated flame holder 102. The control circuit 103 can analyze the images and adjust the combustion reaction based on the images.

According to an embodiment, the control circuit 103 is configured to cause the electroresistive tomography device 805 to capture one or more images of the combustion reaction. In one embodiment, the control circuit 103 is further configured to analyze the one or more images and to adjust the characteristics of the combustion reaction based on the analysis of the one or more images.

Figure 8B:
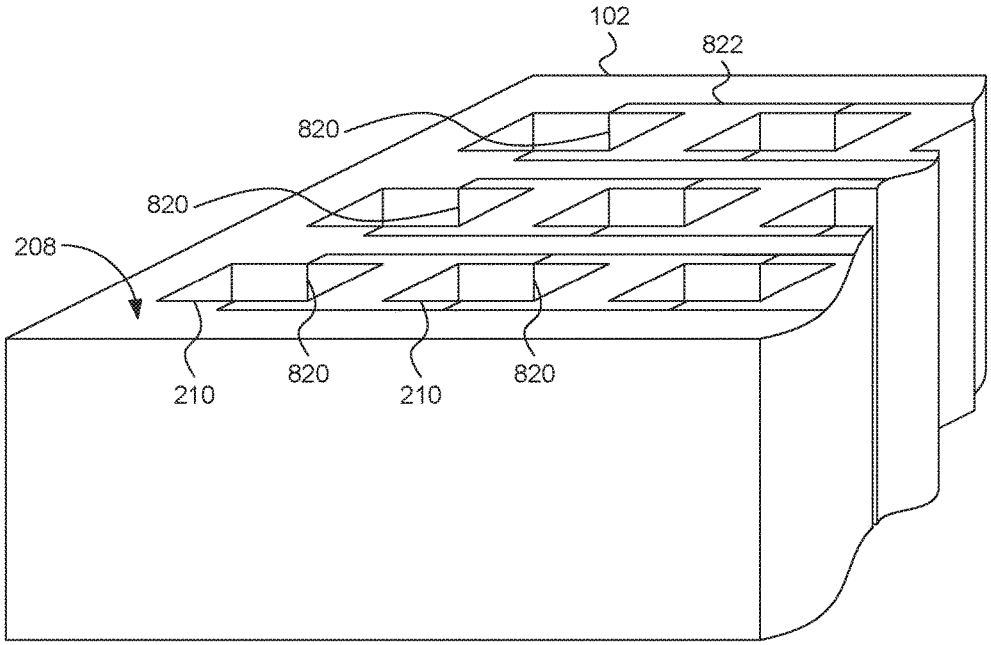
FIG. 8B is a perspective view of a portion of the perforated flame holder and electroresistive tomography system of FIG. 8A, according to an embodiment.

FIG. 8B is a perspective view of a portion of a perforated flame holder 102 including an electro resistive tomography device 805, according to an embodiment. A plurality of electrodes 820 are positioned within the perforations 210 of the perforated flame holder 102 and coupled to conductive wires 822 that extend along the top surface of the perforated flame holder 102. The electrodes 820 are each coupled to a wire 822. For simplicity, FIG. 8B depicts multiple electrodes 820 coupled to a single wire 822, in practice each electrode 820 may be coupled to a different wire 822 that extends along the top surface of the perforated flame holder 102, so that the resistance in each perforation 210 may be measured individually. The wires 822 can be coupled to the control circuit 103. The control circuit 103 can apply a voltage between each pair of electrodes 820 in order to determine the resistance of each perforation 210, generating an image of the perforated flame holder 102 based on the resistances.

Figure 9:
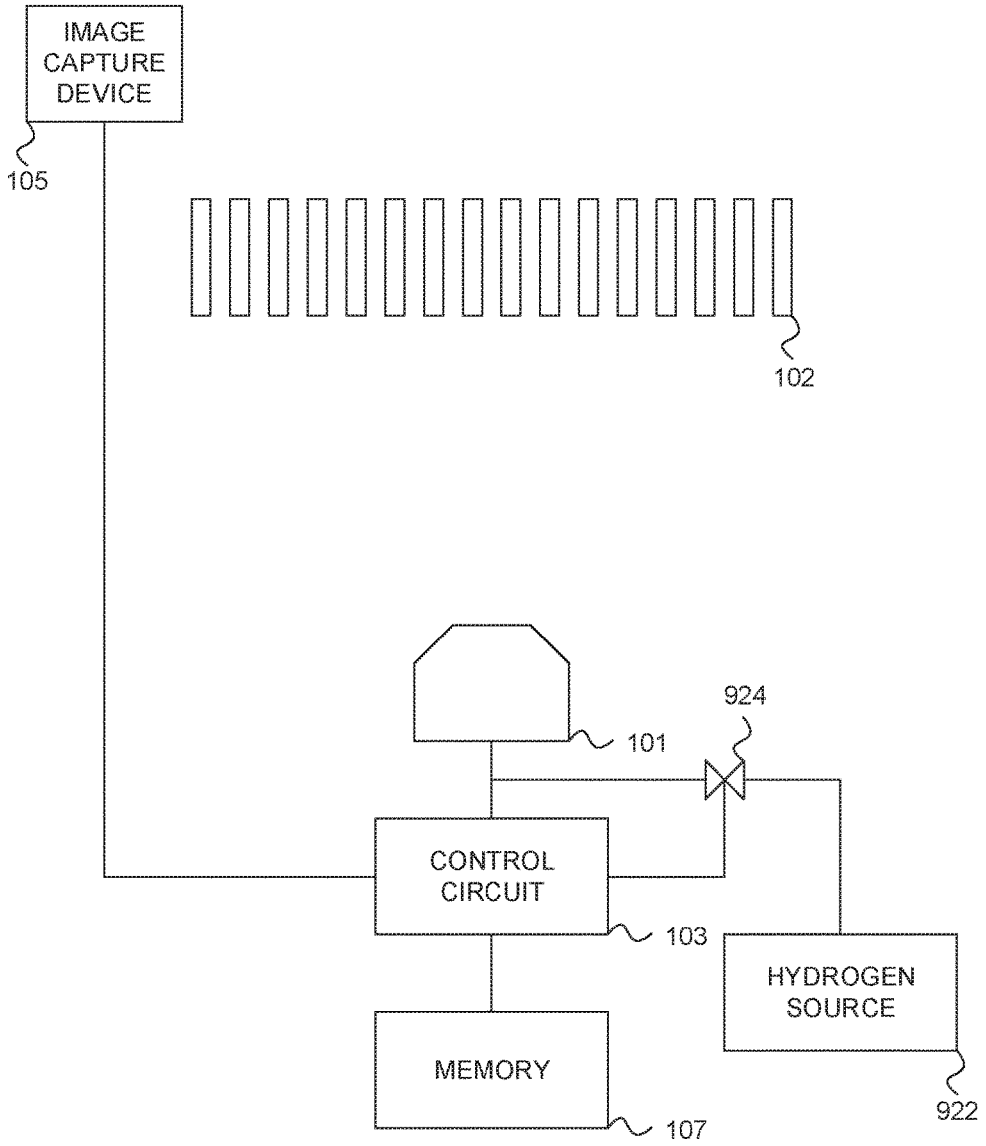
FIG. 9 is a diagram of a combustion system including a perforated flame holder and an image capture device, according to an embodiment.

FIG. 9 is a diagram of a combustion system 500, according to an embodiment. The combustion system 500 includes a fuel and oxidant source 101, a perforated flame holder 102, a control circuit 103, an image capture device 105, and a memory 107. The combustion system 500 further includes a hydrogen source 922 coupled to the fuel and oxidant source 101 by a valve 924. The control circuit 103 can control the operation of the valve 924 to allow more or less hydrogen to be output from the fuel and oxidant source 101.

According to an embodiment, the fuel and oxidant source 101 includes, for example, a fuel nozzle configured to output fuel and oxidant onto the perforated flame holder 102. The perforated flame holder 102 sustains a combustion reaction of the fuel and oxidant primarily within the perforated flame holder 102. The control circuit 103 is configured to cause the image capture device 105 to capture one or more images of the combustion reaction. In one embodiment, the control circuit 103 is further configured to analyze the one or more images and to adjust the characteristics of the combustion reaction based on the analysis of the one or more images.

According to an embodiment, the control circuit 103 adjusts the characteristics of the combustion reaction by adjusting the valve 924 to provide more or less hydrogen to the fuel and oxidant source 101. In one example, when the perforated flame holder 102 appears darker based on the image or images, the control circuit 103 can actuate the valve 924 to add hydrogen to the fuel in order to pull the combustion reaction back down within the perforated flame holder 102. Additionally or alternatively, when the perforated flame holder 102 appears dark, the control circuit 103 can activate a valve 924 to switch to a larger cumulative fuel nozzle orifice cross-sectional area in order to reduce fuel velocity. This also will help pull the combustion reaction down into the perforated flame holder 102. Alternatively, the control circuit 103 can output a signal or message that indicates to a technician to manually operate the valve 924 to adjust the amount of hydrogen supplied to the fuel and oxidant source 101 or to manually operate a valve or other mechanisms to increase or decrease the cumulative fuel nozzle orifice cross-sectional area.

While the fuel and oxidant source 101 and the hydrogen source 922 are depicted as being separate in FIG. 9, in practice the hydrogen source 922 and the valve 924 can be a part of the fuel and oxidant source 101.

Figure 10:
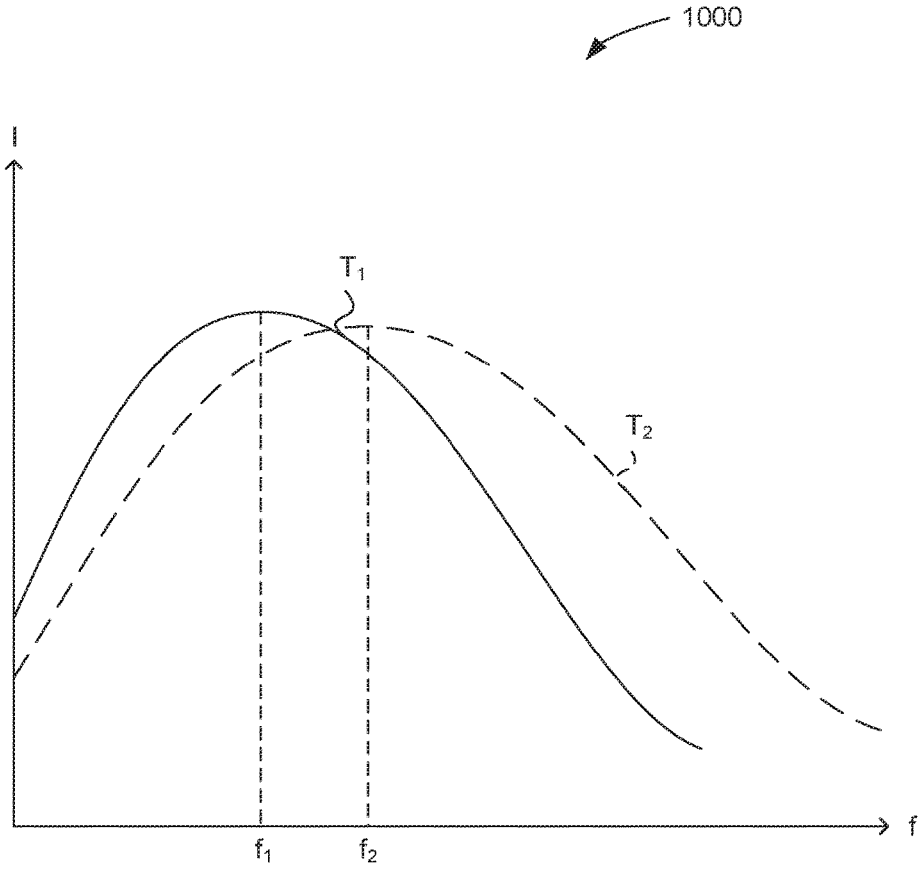
FIG. 10 is a graph of the intensity of light emitted from a perforated flame holder versus the wavelength of light, according to an embodiment.

FIG. 10 is a graph illustrating the relative intensity I of light output from the perforated flame holder 102 and/or the combustion reaction as a function of the frequency f of light. Two curves are shown in FIG. 10 for two different temperatures of perforated flame holder 102. At a first lower temperature T1, the peak intensity occurs at a frequency f1. At a second higher temperature T2, the peak intensity occurs at a frequency f2. Thus, as the temperature increases, the peak intensity occurs at a high frequency of light (more blue). The control circuit 103 can determine what is the temperature of the perforated flame holder 102 based on the distribution of various frequencies of emitted light as captured in the images. The control circuit 103 can then adjust the parameters of the combustion reaction accordingly. While FIG. 10 is described in relation to frequencies of emitted light, more commonly the wavelength λ of light may be measured/analyzed. The wavelength λ and frequency f of light are related to each other, and to the speed of light c, by the equation:

$$\lambda = c/f.$$

Figure 11:
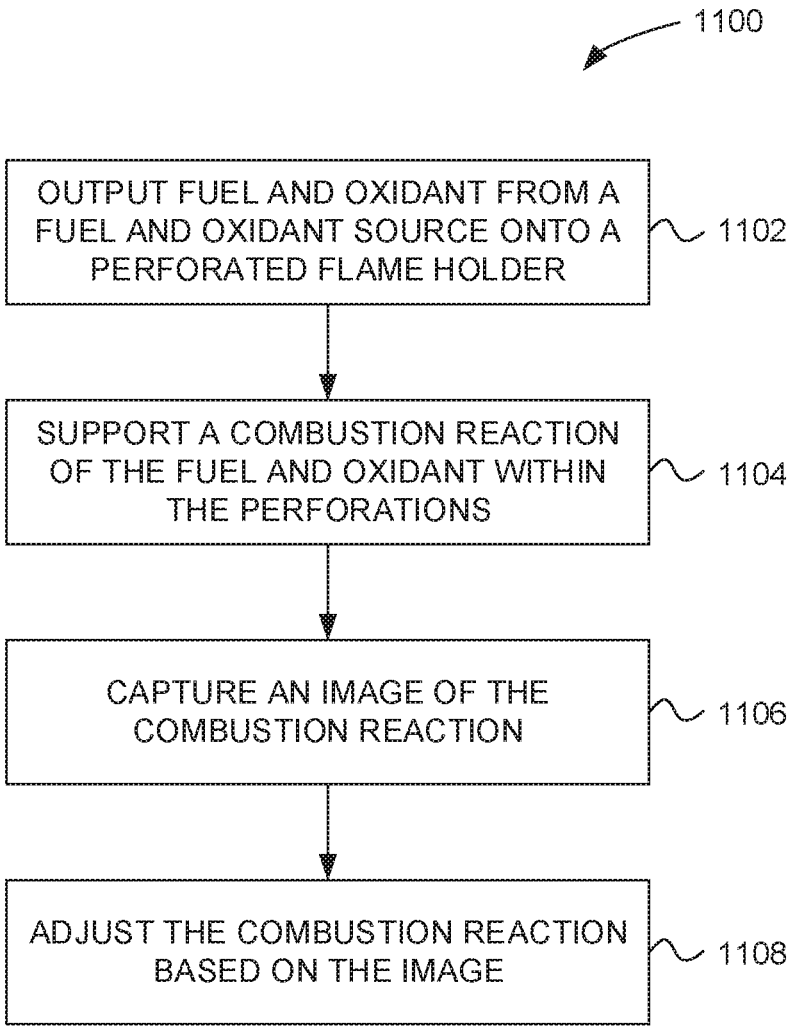
FIG. 11 is a flow diagram for a process for operating a combustion system including a perforated flame holder and an image capture device, according to one embodiment.

FIG. 11 is a flow diagram of a process 1100 for operating a combustion system, according to an embodiment. At 1102, the fuel and oxidant source outputs fuel and oxidant onto a perforated flame holder. At 1104 the perforated flame holder supports a combustion reaction of the fuel and oxidant within the perforations of the perforated flame holder. At 1106, the image capture device captures one or more images of the combustion reaction. At 1108 the combustion reaction is adjusted based on the one or more images. The combustion reaction can be adjusted by a control circuit or by a technician. The combustion reaction can be adjusted, for example, by adjusting the output of fuel and oxidant onto the perforated flame holder. This can be done automatically by the control circuit, or manually by a technician, according to an embodiment.

While various aspects and embodiments have been disclosed herein, other aspects and embodiments are contemplated. The various aspects and embodiments disclosed herein are for purposes of illustration and are not intended to be limiting, with the true scope and spirit being indicated by the following claims.

What is claimed is:

1. A system, comprising:

a fuel and oxidant source configured to output fuel and oxidant;

a perforated flame holder including:

a first face;

a second face; and a plurality of perforations extending between the first face and the second face, the first face being positioned to receive the fuel and oxidant from the fuel and oxidant source, wherein the perforated flame holder is disposed to receive the fuel and oxidant and configured to sustain combustion of the fuel and oxidant primarily within the plurality of perforations of the perforated flame holder;

an image capture device configured to capture a plurality of images of the combustion; and a control circuit configured to produce from the plurality of images an averaged image of the combustion, for adjusting the combustion reaction based on the averaged image.

2. The system of claim 1, wherein the image capture device is a camera.

3. The system of claim 1, wherein the image capture device is configured to capture images in a visible spectrum.

4. The system of claim 1, wherein the image capture device is configured to capture images in an infrared spectrum.

5. The system of claim 1, wherein the image capture device is configured to capture images in an ultraviolet spectrum.

6. The system of claim 1, wherein the image capture device is a flame scanner.

7. The system of claim 1, wherein the control circuit is configured to adjust the combustion based on the averaged image.

8. The system of claim 1, comprising a memory coupled to the control circuit and configured to store reference data.

9. The system of claim 8, wherein the control circuit is configured to compare the averaged image to the reference data stored in the memory.

10. The system of claim 9, wherein the control circuit is configured to adjust the combustion based on the comparison between the averaged image and the reference data.

11. The system of claim 10, wherein the reference data is generated by one or more flame averages collected by the system.

12. The system of claim 10, wherein the reference data includes a combustion reaction reference image.

13. The system of claim 12, wherein the control circuit is configured to adjust the combustion to conform to the combustion reaction reference image.

14. The system of claim 8, wherein the reference data includes a plurality of combustion reaction reference images illustrative of a plurality of operating conditions stored in the memory.

15. The system of claim 14, wherein the reference data corresponds to a reference image best matched to the averaged image.

16. The system of claim 9, further comprising an image display apparatus configured to display the averaged image, wherein the control circuit is configured to store the averaged image in the memory.

17. The system of claim 1 wherein the control circuit is configured to adjust the combustion by stopping the output of fuel from the fuel and oxidant source.

18. A method comprising:

outputting fuel and oxidant from a fuel and oxidant source onto a perforated flame holder;

supporting combustion of the fuel and oxidant primarily within the plurality of perforations of the perforated flame holder, wherein the perforated flame holder includes a first face, a second face, and a plurality of perforations extending between the first face and the second face, the first face being positioned to receive the fuel and oxidant from the fuel and oxidant source;

capturing an image of the combustion reaction with an image capture device; and adjusting the combustion reaction based on the image.

19. The method of claim 18, comprising:

passing the image to a control circuit; and adjusting the combustion by altering, with the control circuit, the output of fuel and oxidant from the fuel and oxidant source.

* * * * *